US007878447B2

(12) United States Patent
Hartzheim

(10) Patent No.: US 7,878,447 B2
(45) Date of Patent: Feb. 1, 2011

(54) UNWIND AND FEED SYSTEM FOR ELASTOMERIC THREAD

(75) Inventor: Richard J. Hartzheim, Appleton, WI (US)

(73) Assignee: OverEnd Technologies, LLC, Appleton, WI (US)

( * ) Notice: Subject to any disclaimer, the term of this patent is extended or adjusted under 35 U.S.C. 154(b) by 0 days.

(21) Appl. No.: 12/592,446

(22) Filed: Nov. 25, 2009

(65) Prior Publication Data

US 2010/0072316 A1 Mar. 25, 2010

Related U.S. Application Data

(62) Division of application No. 11/648,473, filed on Dec. 29, 2006.

(60) Provisional application No. 60/755,127, filed on Dec. 30, 2005.

(51) Int. Cl.
*B65H 57/14* (2006.01)

(52) U.S. Cl. ..... 242/615.2; 242/418.1; 242/419.9; 242/615.3; 242/131.1

(58) Field of Classification Search ..... 242/131.1, 242/615.2, 419.9, 418.1, 155 BW, 615.3, 242/131, 593, 412.1
See application file for complete search history.

(56) References Cited

U.S. PATENT DOCUMENTS

| | | | | |
|---|---|---|---|---|
| RE21,967 | E | 12/1941 | Tobias | |
| 2,429,798 | A | 10/1947 | Bradnack et al. | |
| 2,514,691 | A | 7/1950 | Boucraut | |
| 2,768,796 | A | 10/1956 | Levine | |
| 2,838,923 | A | 6/1958 | Lassiter | |
| 2,920,772 | A | 1/1960 | Wilhelm et al. | |
| 3,642,218 | A | 2/1972 | Furst | |
| 3,797,767 | A | 3/1974 | Schippers et al. | |
| 3,858,416 | A | 1/1975 | White et al. | |
| 3,999,715 | A | 12/1976 | Schippers et al. | |
| 4,186,896 | A * | 2/1980 | Brandenberger et al. | 242/131 |
| 4,471,917 | A | 9/1984 | Whisnant | |

(Continued)

FOREIGN PATENT DOCUMENTS

| | | |
|---|---|---|
| DE | 3739175 | 6/1988 |

(Continued)

OTHER PUBLICATIONS

BTSR, KTF-100RW, Catalog, Undated, 2 pages, Italy, publication date unknown.

*Primary Examiner*—William E Dondero
(74) *Attorney, Agent, or Firm*—Thomas D. Wilhelm; Wilhelm Law, S.C.

(57) ABSTRACT

An overend unwind system for unwinding tacky elastomeric fiber threads such as uncoated spandex thread, capturing the ballooning affect of the thread as the thread leaves the spool, applying a first-stage tension control on the thread adjacent where the thread leaves the spool, feeding the unwound thread to a nip in a downstream process, and applying a final tension increment to the thread adjacent where the thread enters the downstream process. All thread guide surfaces encountered by the thread after leaving the spool, and while the thread is under designed operating tension, are moving surfaces, such that the tensioned thread thereby experiences a reduced level of drag as the thread traverses its path of travel from the spool to the downstream process.

66 Claims, 11 Drawing Sheets

U.S. PATENT DOCUMENTS

| | | | | |
|---|---|---|---|---|
| 4,610,402 | A | | 9/1986 | Corbett et al. |
| 4,666,542 | A | | 5/1987 | De Jonckheere |
| 4,752,044 | A | | 6/1988 | Memminger et al. |
| 4,792,101 | A | | 12/1988 | Van Bogaert et al. |
| 5,172,734 | A | | 12/1992 | Matsui et al. |
| 5,342,000 | A | * | 8/1994 | Berges et al. ..... 242/155 M |
| 5,566,574 | A | | 10/1996 | Tiziano |
| 5,624,082 | A | | 4/1997 | Ligon |
| 5,676,328 | A | | 10/1997 | Threlkeld et al. |
| 5,752,549 | A | | 5/1998 | Derudder et al. |
| 5,810,271 | A | * | 9/1998 | Hamilton ..... 242/131.1 |
| 5,838,570 | A | | 11/1998 | Barea |
| 6,158,689 | A | | 12/2000 | Mayer et al. |
| 6,321,576 | B1 | | 11/2001 | Barea |
| 6,513,748 | B2 | | 2/2003 | Zeller et al. |
| 6,676,054 | B2 | | 1/2004 | Heaney et al. |
| 2004/0104299 | A1 | | 6/2004 | Heaney et al. |
| 2005/0133653 | A1 | | 6/2005 | Heaney et al. |
| 2006/0011771 | A1 | | 1/2006 | Manning, Jr. et al. |
| 2008/0283653 | A1 | | 11/2008 | Bing-Wo et al. |

FOREIGN PATENT DOCUMENTS

| | | | |
|---|---|---|---|
| DE | 19652620 | | 6/1997 |
| GB | 1246318 | | 9/1971 |
| WO | 02076866 | | 10/2002 |
| WO | WO 03093550 A1 | * | 11/2003 |

* cited by examiner

Fig.4
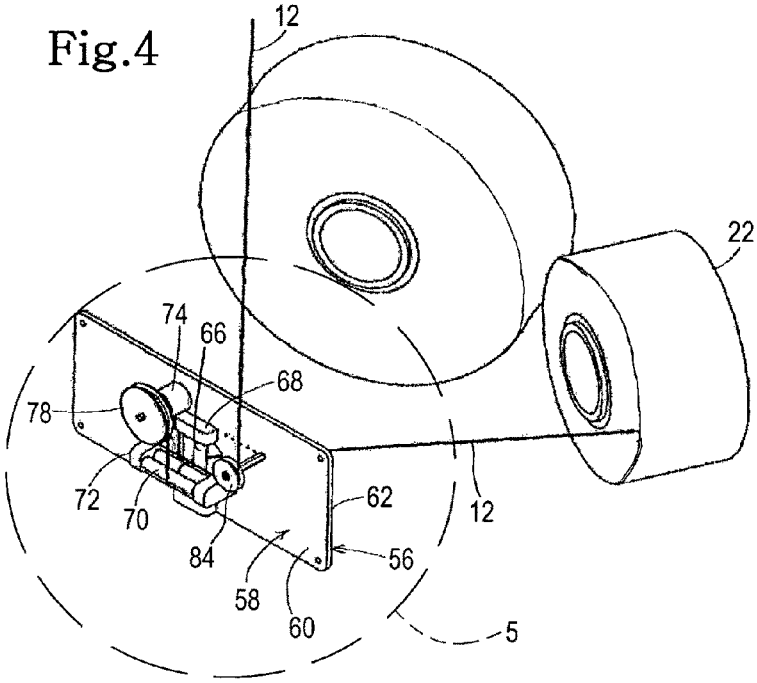
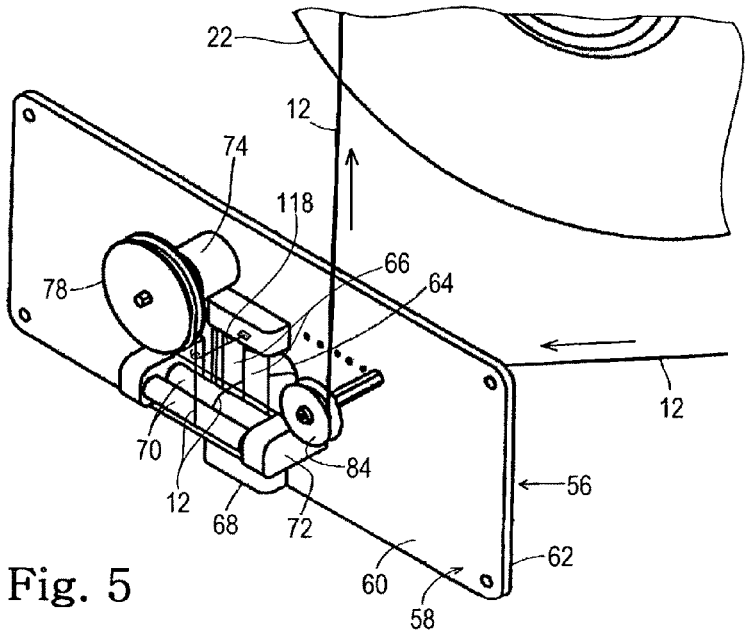
Fig. 5

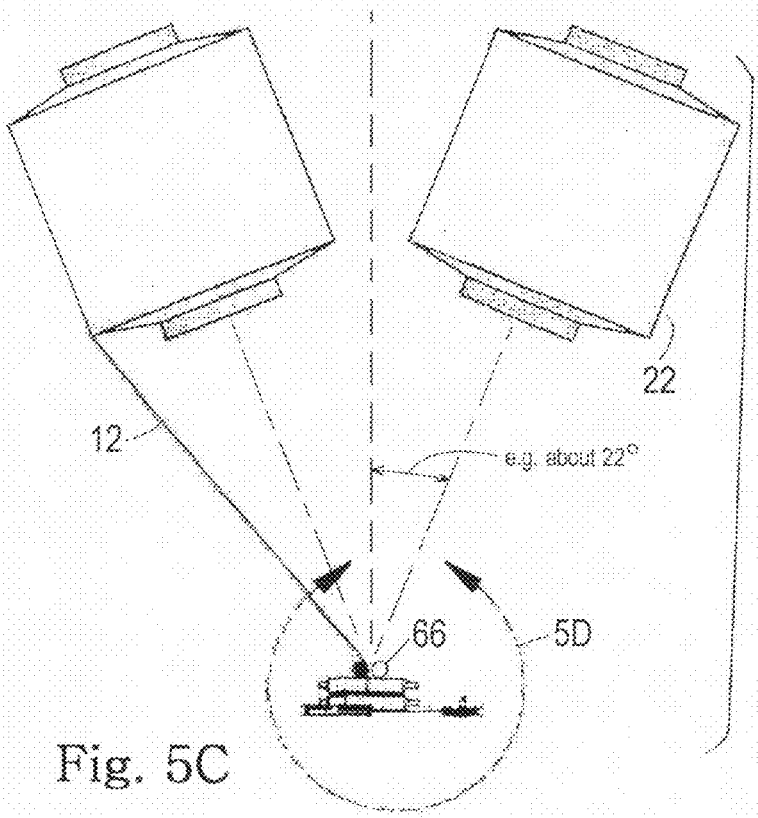
Fig. 5C
Fig. 5D
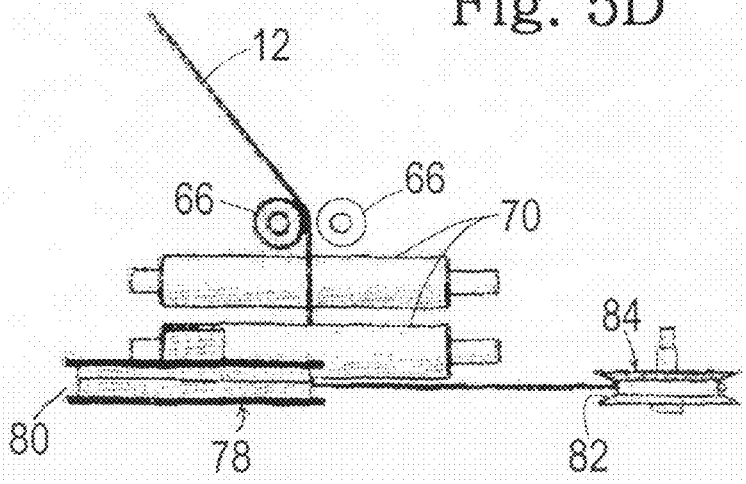

UNWIND AND FEED SYSTEM FOR ELASTOMERIC THREAD

CROSS-REFERENCE TO RELATED APPLICATIONS

This application claims priority under 35 U.S.C. §120 as a divisional of U.S. application Ser. No. 11/648,473, filed Dec. 29, 2006, which claims priority to U.S. provisional application Ser. No. 60/755,127, filed Dec. 30, 2005; all the above of which are incorporated herein by reference in their entireties.

BACKGROUND

This invention relates generally to unwind devices and feed controls which are used for unwinding highly elastic and tacky threads from a spool/package of such thread, and feeding such threads into a manufacturing process which uses and/or further processes such threads.

In general, a spool/package of the desired thread is mounted on an unwind stand. Thread from the spool/package is threaded by hand into the manufacturing process at process start-up. As the manufacturing process which uses the thread proceeds, thread is pulled from the package and guided to the manufacturing process.

One method of unwinding and feeding thread from a spool of such thread in manufacturing processes is referred to as a "rolling unwind". In the rolling unwind method, the package/spool is mounted in an unwind stand with the axis of rotation of the package/spool oriented generally perpendicular to the direction in which the thread is to be drawn from the package. The spool/package turns at a speed which is related to the unwind speed, allowing for a desired feed rate, so as to feed the thread from the rotating package along a line which generally approximates a perpendicular to the axis of rotation of the spool of thread and which is generally tangent to the outer surface of the thread on the spool.

When a first package of the thread is exhausted, the manufacturing process is shut down. The first package is removed. A second package is installed and threaded up.

A major disadvantage of a rolling such unwind operation is that the manufacturing process must be shut down every time a spool of thread is exhausted. Since the manufacturing process typically draws a plurality of material feeds from a plurality of source packages of thread, shutting down the entire manufacturing process when a single source is exhausted typically results in substantial down-time losses and substantial production of scrap during shut-down and start-up. Accordingly, in one method of controlling the amount of down-time, when one roll has been exhausted and the process is shut down, all rolls relating to that process are replaced with full rolls irrespective of the amount of thread remaining on a given spool. The result is the wasting of the thread which remains on those spools which are not exhausted.

Another method of unwinding and feeding thread from the spool is known as the overend take-off method (OETO). In the overend take-off method, the package of thread is fixedly mounted on the unwind stand so that the axis of rotation of the package is pointed in the general direction of the path to be traversed by the thread as the thread is drawn from the package. However, in the overend take-off method, the package of thread does not rotate as the thread is being drawn from the package. Rather, the thread comes off the spool over the end of the spool. As the thread leaves the spool, the locus of departure rotates about the circumference of the spool, such that the path initially traversed by the thread is rotational in nature. At lower speeds, the thread gets just past the 12 o'clock position on the spool and drops to the 6 o'clock position. At higher speeds, the thread rotational action embodies centripetal forces which are acting essentially perpendicular to the general direction of travel of the thread, whereby the thread leaving the spool looks much like a loop, a jump rope, or hoop, or ballooning action. All such actions are intended to be included in referring to the action of the thread as a "loping" action. Such loping action must be controlled, damped out, so that the thread can be guided at controlled tension and direction along a predetermined path, in such a manner as to be delivered, fed, to the manufacturing process at a controlled and generally constant, though changeable, level of tension. In achieving the generally constant level of tension, the tension spikes and other tension variations, which are inherent in the overend dispensing of such a sticky thread, must be dissipated within the unwinding and feeding mechanism.

Since the spool is fixed in location, the operator can tie the trailing end of a first active spool to the leading end of a next-in-line reserve spool such that the tail end of an active spool automatically transfers the feed to the reserve spool when the active spool is exhausted, whereby there is no need to stop the manufacturing process to change spools. Accordingly, overend feeding inherently avoids the above-noted wasting of thread on changed-out spools where the thread supply has not all been used up, as well as the shut-down, start-up times associated with such spool change-outs Thus, overend feeding embodies built-in cost savings related to both materials usage and production output, whereby overend unwinding is a desirable technology for unwinding tacky threads and feeding such tacky threads into a manufacturing process.

However, overend unwinding and feeding technology has its own challenges to successful operation. In conventional overend unwind technology, the thread coming off the spool is first fed through a circular ceramic eye to suppress the jump rope, hoop, ballooning characteristic of the thread coming off the spool. In a creel which supports and controls a plurality of simultaneously-active threads, each thread is initially fed through a separate such circular ceramic eye, and the threads are fed from the initial circular ceramic eyes to a common driven roll. The driven roll treats all of the threads the same. Namely, each thread passes over, through its own groove on the driven roll, whereby all of the threads are individually treated to a common roll drive and/or retardation.

The purpose of such driven roll is to capture and eliminate laterally-directed kinetic energy in a thread and to absorb and eliminate longitudinally-directed force/tension variations in the thread. Tension both before and after the driven roll can vary widely depending on winding tension in the spool, as well as the experience of the thread between the spool and the driven roll. The result is that thread speed is controlled at the driven roll, while tension continues to vary from thread to thread in a given unwind operation on an unwind stand. But there is no sensing, no direct control, of the tension in individual ones of the threads leaving the driven roll. Nor is there any sensing, any direct control, of the tension in the collective combination of the threads leaving the driven roll. And there is no control of tension in the threads between the driven roll and the manufacturing nip where the threads enter the product assembly operation.

Still referring to conventional overend technology, from the driven roll, the threads make their ways, along pre-determined paths, to respective entrance points into the manufacturing process. Given the layout of a typical manufacturing line for personal hygiene products where such threads are commonly used, there is commonly no space for the unwind creel immediately adjacent the point of entry of the threads into the manufacturing process.

So a common location for the unwind creel is across an aisle or walkway from the manufacturing process line. Thus, the distance which the thread travels, from the driven roll on the unwind creel, to the point of entry at a nip in the manufacturing process, is several meters, typically about 10 meters. Further, each thread passes over a number of turning rolls and guides in traversing along the thread path, from the unwind creel to the manufacturing process, including across the aisle/walkway. In such traversing, each thread passes over a separate and distinct set of guides and rolls, separate and distinct from the set of guides and rolls traversed by any other thread.

Each such turning roll or guide adds a measure of tension to the respective thread. By the time the thread gets to the process nip, the tension in the thread has been changed by its contacts with the respective guides and rolls, such that the tension on a given thread entering the nip at the manufacturing process is different from the tension on that same thread as the thread leaves the driven roll on the creel. Further, the tension increment at each such guide or roll is different depending on surface characteristics of that guide/roll, efficacy of the bearings if any, any dirt or lubricant which may have accumulated on the surface of the guide or roll, any dirt or other detritus which may have gotten into roll bearings, or the like. Overall, in conventional overend technology, the tension entering the manufacturing nip is not well controlled by controlling the speed or tension at a driven roll which is close to the elastic fiber spool and relatively farther from the manufacturing nip.

A further problem with conventional unwind systems is that the ceramic eye, which is first encountered by the thread as the thread leaves the spool, is motionless, and thus exerts a static friction drag on the loping, jump-rope, thread which is passing through the eye. Where, as here, the thread is an elastomeric fiber such as spandex thread, which is bare and substantially free of finish, the fiber-to-fiber and fiber-to-ceramic frictional characteristics are significantly higher than with covered or lubricated fibers. Thus, a significant drag results when this very tacky thread is pulled across the static ceramic surface of the eye guide. The rotational ballooning action of the thread, as the thread is pulled from the package, causes the thread to be dragged along the edges of the ceramic eye guide rather than straight through the center of the eye. The frictional drag, between the static eye and the tacky thread, is exacerbated as the angle of wrap of the thread around the edge of the static eye guide is increased. Because of the jump-roping motions, the angle of contact with the static ceramic eye is constantly changing. Therefore, the amount of friction at the static eye is constantly changing, resulting in alternating large and sudden increases and decreases in tension, and accompanying sticking and slipping of the thread at the ceramic eye. The resulting friction is neither constant nor predictable, whereby the thread is also experiencing ongoing and constant substantial changes in speed of advance of the thread along the thread path.

While this invention is capable of handling a wide variety of thread types, the advantages of this invention are readily experienced in handling unwind and transport of untreated elastomeric fiber thread. Such elastomeric fiber thread is uncoated, having no lubricant, no oil on its surface. The thread can be an "as spun" thread, or a rewound thread. The rewound thread has a much more consistent drag, tension as it is unwound from the spool, than an "as spun" thread. The thread has a size in the range of about 200 decitex to about 2000 decitex, typically about 400 decitex to about 1000 decitex.

Typical tension in the thread as it leaves the package can be as little as about 2 grams for a rewound thread. For an as-spun thread, the tension as the thread leaves the package typically averages about 5 grams to about 20 grams. However, the tension varies substantially depending on stage of the unwind at which the tension is being measured. For example, where the average tension e.g. over a 10 minute period is measured as 6 grams at the outside of the package, e.g. when unwinding of that package has just started, the average tension just before the unwinding reaches the core or end of the package is substantially higher such as 12 grams.

When real-time tension is measured in very short increments such as at 0.1 second increments, thread-to-thread sticking reveals substantially greater spikes in tension differences, from a tension of effectively zero to a tension as high as 30-40 grams or higher, all in the course of e.g. releasing a single wrap from the spool.

The overall objective of the thread feed is to convert a roll of wound up elastomeric fiber thread, from a highly variable tension as the thread leaves the spool, to a thread which feeds into the manufacturing nip at a constant and controllable tension of about 80 grams to about 250 grams, depending on the thread decitex and the finished manufacturing product specifications.

Thus it is desired to provide an overend thread unwind system for elastomeric and tacky threads which is effective to capture the loping, jump rope, activity of the thread as the thread is unwound from the spool.

It is a further desire to capture the loping, jump rope, activity of the thread while applying a minimal amount of friction and/or drag force on the thread.

It is still further desirable to capture the loping, jump rope, thread with a travelling e.g. rotating or rolling, capture device, such that the thread does not necessarily routinely travel over any static surfaces.

It is further desirable to capture the loping, jump rope thread with rotating devices which are closed on opposing ends of the device such that the thread cannot come off the capture device by moving laterally along the axis of rotation of the device and past the end of the device, and whereby the thread will be prevented from moving off the device by the end closure structure.

It is yet further desirable to exert a first-stage tension control input on the thread at the unwind creel close to the elastic thread package and to exert a second-stage tension control input on the thread proximate the manufacturing nip, and whereby the thread traverses no more than a minimal number of thread guides, if any, between the second tensioning device and the manufacturing nip.

It is still further desirable to provide a manufacturing operation wherein a tacky thread is fed into the product assembly operation at a constant tension, controlled by an unwind and feed system which exerts a final tension control on the thread at an up-stream location proximate the entrance of the thread into the product assembly operation, such that the thread typically experiences no more than three, optionally no more than one or two, guide surfaces after departing the final tensioning device, and wherein the final tensioning device is no more than three meters, optionally no more than one or two meters, from entrance of the thread into the manufacturing nip.

Tensioning devices such as the BTSR brand KTF-RW constant tension feeder are typically used as stand-alone devices. Parameters such as tension setpoint, tension deviation alarm window, system responsiveness/reactivity, etc. are usually set at each individual device. Dynamic status values such as tension feedback, drive current, drive temperature, and system health status are usually only available for display on each tensioning device drive module.

Hand-held programming devices and PC-based software systems exist which can be used for the initial setup of the tensioning devices. However none of such devices provide for integration of the tensioning devices with the industrial programmable logic controllers (PLC's) which are standard in automated manufacturing processes.

Standard practices and controls procedures for most automated industrial manufacturing processes, especially in the personal care industries, such as the hygiene industry, the baby diaper industry, and the adult incontinent industry, require complete integration of all devices and sub-systems which participate in the manufacturing operation. All operating parameters for all devices in the entire manufacturing line must be set and monitored from a central operator interface, usually a touch screen, which in turn is connected to the central PLC. The central PLC manages all of the setpoint parameters and monitors feedback and status data from all devices on the production line.

Conventional, off-the-shelf tensioning devices require direct or local input of control parameters into the individual devices, and thus do not conform to such centralized control scheme, and are therefore prohibited from use in many manufacturing environments. There is a need for a means to fully integrate the control and monitoring of setpoints, feedback, and status values of tensioning devices into an automated manufacturing system.

Production lines used in the manufacture of hygiene, baby diaper, adult incontinent, and related products are complex, with highly sophisticated control systems. Due to the complexity of the programming in the main system PLC, it is a difficult, time-consuming, and expensive process to make significant program changes to a functioning production line. Therefore, when the new accessory or sub-system, namely the elastic feeding equipment of the invention is added to the production line, it is generally preferable for the time-critical functions of such sub-system to be handled by a secondary controller which then communicates with the main PLC. Setpoint information for the subsystem is sent to the secondary controller from the main PLC. Feedback and status information are sent from the secondary controller to the main PLC.

SUMMARY OF THE INVENTION

In general, this invention provides an overend unwind system which is especially adapted for unwinding tacky elastomeric fiber threads such as uncoated spandex thread, damping out the ballooning affect and major tension spikes of the thread shortly after the thread leaves the spool, applying a first coarse tension control on the thread in the vicinity of where the thread leaves the spool, feeding the unwound thread to a nip in a manufacturing operation, and applying a second refining tension control to the thread adjacent where the thread enters the manufacturing nip. The unwind system thus smoothes out tension variations in the unwound thread using a such two-stage tension-control system, wherein the first-stage coarse-tension control reduces tension variations along the length of the thread and the second-stage fine-tension control further reduces and/or eliminates the remaining tension variations and sets the thread tension to the desired value proximate the location where the thread enters the product assembly operation. Thus, the 2-stage tension control system of the invention acts like an extended-length 2-stage shock absorber, effective to substantially dampen the tension variations which exist in the thread as the thread leaves the spool. With the exception of a tension sensor, all thread guide surfaces encountered by the thread after leaving the spool, and while the thread is under tension, are moving surfaces, such that the tensioned thread, using apparatus and processes of the invention, never passes over a static guide surface other than the tension sensor, and thereby experiences a reduced level of drag as the thread traverses its thread path from the spool to the manufacturing nip.

In a first family of embodiments, the invention comprehends an unwind and feed system adapted for overend unwinding of an elastic thread from a package of such thread in a manufacturing process, and feeding such unwound thread in a downstream direction, along a thread feed path, to a product assembly operation, the unwind and feed system comprising a frame, including a device adapted to hold a package of thread; and a plurality of thread guides disposed along the thread feed path, between such package of such thread and such product assembly operation, the plurality of thread guides being adapted to guide such thread along the thread feed path, the plurality of thread guides comprising (i) a first thread guide closest to the thread package holder, (ii) a second thread guide downstream from the first thread guide, along the thread path, and (iii) a third thread guide downstream from the second thread guide, along the thread path, all of the plurality of thread guides, between such package of such thread and such manufacturing process, comprising moving-surface thread guides such that, in routine ongoing operation of the unwind and feed system, other than any tension sensor, such thread encounters only moving-surface thread guides.

In some embodiments, the thread guides are adapted to move thread contact surfaces of the thread guides at surface speeds which approximate speeds of movement of such thread.

In a second family of embodiments, the invention comprehends an unwind and feed system adapted for overend unwinding of an elastic thread from a package of such thread in a manufacturing process, and feeding such unwound thread in a downstream direction, along a thread feed path, to a product assembly operation, the unwind and feed system comprising a frame, including a device adapted to hold a package of thread; a plurality of thread guides disposed along the thread feed path, between such package of thread and such product assembly operation, the plurality of thread guides being adapted to guide such thread along the thread feed path; and a tension control system, adapted to control tension in such thread along the thread feed path, including a terminal tensioning device which acts on such thread in the thread feed path within 3 meters of a locus where the thread feed path joins such product assembly operation, the terminal tensioning device being adapted to intentionally modify tension in such thread.

In some embodiments, the terminal tensioning device is adapted to modify tension in such thread to an extent greater than tension modifications which are conventionally imparted to such thread by conventional rolling-surface thread turning devices.

In some embodiments, the terminal tensioning device actively modifies tension in such thread.

In some embodiments, the terminal tensioning device has a target setpoint, and wherein the setpoint is adjustable thereby to increase or decrease a setpoint tension at which such thread leaves the terminal tensioning device.

In some embodiments, the terminal tensioning device comprises a closed-loop tensioning device which is capable of actively increasing or decreasing tension in such thread to achieve a desired tension in thread exiting the terminal tensioning device.

In some embodiments, the terminal tensioning device comprises a closed loop braking device which is capable of actively increasing tension in such thread to achieve a desired final tension in thread exiting the terminal tensioning device.

In some embodiments, all of the thread guides, except any tension sensor, are moving/rolling thread guides.

In some embodiments, the thread guides are adapted to move thread-contact surfaces of the thread guides at surface speeds which approximate speeds of movement of such thread.

In some embodiments, the invention further comprises an operator control station communicating with the tension control system, and adapted to send at least one of tension value, enable or disable switching signals, and alarm setpoint values to the tension control system, and/or to receive at least one of feedback tension values and status information from the tension control system.

In some embodiments, the unwind and feed system is operationally connected into a manufacturing system, the manufacturing system comprises a main controller, and the main controller communicates with the unwind and feed system through the operator control station.

In some embodiments, the main controller has an operator interface, and an operator of the manufacturing system can communicate with the tension control system, and thereby control the terminal tensioning device, through the operator interface.

In a third family of embodiments, the invention comprehends a manufacturing system, comprising a plurality of devices which collectively control passage of an elastic thread along a thread path from a package of such thread to a destination, including a thread tensioning device; a control system adapted to control operations of the plurality of devices, the control system comprising (i) a main industrial-grade programmable logic controller which provides primary monitoring and operational control, through a primary operator interface, of the manufacturing system, and (ii) a secondary controller, adapted to communicate with the thread tensioning device, and the main industrial-grade programmable logic controller using industrial-grade communications protocol, whereby the secondary controller enables communication between the main programmable logic controller and the thread tensioning device, such that an operator of the manufacturing system can control operation of adjustment capabilities of the thread tensioning device from the primary operator interface.

In some embodiments, the manufacturing system manufactures personal care hygiene products.

In some embodiments, the secondary controller is adapted to send at least one of tension value, enable or disable switching signals, and alarm setpoint values to the tensioning device, and/or to receive at least one of feedback tension values and status information from the tensioning device.

In some embodiments, the secondary controller translates value-based messages received from the main controller into protocol and/or format which can be received and understood by the thread tensioning device and sends such value-based information to the thread tensioning device, and receives messages from the thread tensioning device and translates such messages received from the thread tensioning device into protocol and/or format which can be received and understood by the main controller, and sends such translated messages to the main controller.

In some embodiments, the main controller communicates directly with the thread tensioning device regarding on/off switching-type information, without passing such on/off switching-type information through the secondary controller.

In some embodiments, all communications between the main controller and the thread tensioning device pass through the secondary controller, and is sent from the secondary controller to the thread tensioning device as on/off switching signals.

In some embodiments, all communications between the main controller and the thread tensioning device, including value messages and on/off messages, pass through the secondary controller, and wherein value messages received by the secondary controller, from the main controller, are translated by the secondary controller into protocol and/or format which can be received and understood by the thread tensioning device.

In some embodiments, the secondary controller sends raw data back to the main controller.

In some embodiments, the secondary controller sends summary information to the main controller.

In some embodiments, the secondary controller stores in non-volatile memory certain historical operating information regarding thread tension, and which operating information is received from the thread tensioning device.

In a fourth family of embodiments, the invention comprehends an unwind and feed system adapted for overend unwinding of an elastic thread from a package of such thread in a manufacturing process, and feeding such unwound thread in a downstream direction, along a thread feed path, to a downstream operation, the unwind and feed system comprising a frame, including a package holding device adapted to hold a package of thread; a thread capture assembly adapted to capture loping thread being drawn overend off such package of thread, the capture assembly comprising (i) first and second rolling capture devices arranged at a generally common distance from such package of thread and serving as initial contact elements for such thread being drawn overend off such package of thread, the first and second rolling capture devices having respective first and second axes of rotation which are parallel to each other and reside in a common plane, and (ii) at least a third rolling capture device proximately downstream from the first and second rolling capture devices, the third rolling capture device having a third axis of rotation generally perpendicular to the axes of rotation of the first and second rolling capture devices, the first, second, and third rolling capture devices collectively capturing both horizontal and vertical vectors of such loping thread, the invention further comprising a plurality of thread guides disposed along the thread feed path downstream of the thread capture assembly, and between the thread capture assembly and such product assembly operation.

In some embodiments, the invention further comprises a fourth rolling capture device located downstream from the third rolling capture device, the fourth rolling capture device having a fourth axis of rotation generally parallel to the third axis of rotation of the third rolling capture device.

In some embodiments, the third rolling capture device is located generally between the fourth rolling capture device and the first and second rolling capture devices.

In some embodiments, the first, second, and third rolling capture devices are all elongate rollers.

In some embodiments, the first and second rolling capture devices are elongate rollers, and the package holding device is oriented so as to direct a central rotational axis of a package of thread, mounted on the holding device, at an angle of about 20 degrees to 90 degrees from the common plane.

In some embodiments, the first, second, third, and fourth rolling capture devices are all elongate rollers, and the package holding device is oriented so as to direct a central rotational axis of a package of thread, mounted on the holding device, at an angle of about 20 degrees to 90 degrees from the common plane.

In some embodiments, the first and second elongate rollers are disposed in a vertical orientation in close proximity to each other, and the third and fourth elongate rollers are disposed in horizontal orientations in close proximity to each other, with the third roller between the fourth roller and the first and second rollers, such that a thread advancing from such thread package first encounters at least one of the first and second rollers, and subsequently encounters the third roller, and after encountering the third roller encounters the fourth roller.

In some embodiments, the first and second thread capture devices have primary affect on reducing magnitude of a first pair of opposing vectors of kinetic energy in such loping thread while having lesser affect on second vectors acting perpendicular to the first pair of opposing vectors of kinetic energy, and wherein the third thread capture device has primary affect on reducing magnitude of second vectors acting perpendicular to the first pair of opposing vectors.

In some embodiments, the first and second elongate rollers have primary affect on reducing magnitude of a first pair of opposing vectors of kinetic energy in such loping thread while having lesser affect on second vectors acting perpendicular to the first pair of opposing vectors of kinetic energy, and wherein the third and fourth elongate rollers have primary affect on reducing magnitude of second vectors acting perpendicular to the first pair of opposing vectors.

In some embodiments, all of the thread guides downstream of the thread capture assembly, except for any tension sensor guide, are rolling thread guides.

In some embodiments, all of the thread guides downstream of the thread capture assembly, except for any tension sensor guide, are rolling thread guides.

In some embodiments, the invention further comprises an un-powered rotating brake disposed downstream of the capture assembly.

In some embodiments, the thread passes from the fourth rolling capture device to the brake, as a next thread-controlling device during normal operation of the unwind and feed system.

In some embodiments, the invention further comprises a threading device between the fourth rolling capture device and the rolling brake and wherein such thread does not touch the threading device during normal operation of the unwind and feed system.

In some embodiments, the thread passes through the first and second upright elongate rollers as the initial contact elements after leaving such package of thread, and the first and second upright rollers act primarily on horizontally-directed vectors of the loping thread and secondarily on vertical vectors of such loping thread, and the axes of rotation of the third and fourth rollers are in a common, generally horizontal plane, and the thread, in proximity to the first and second rollers, passes along a generally horizontal path onto the third elongate roller, turns around the third roller and passes thence onto the fourth roller, and turns around the fourth roller and exits the fourth roller toward, and next encounters a rolling brake disposed downstream of the capture assembly.

In some embodiments, the rolling brake is an un-powered brake, optionally a magnetic brake.

In some embodiments, the thread guides are moving-surface thread guides and the thread guides are adapted to move thread contact surfaces of the thread guides at surface speeds which approximate speeds of movement of such thread.

In some embodiments, the invention further comprises a thread tension control system comprising a first-stage thread tensioning device proximate, and downstream from, the thread capture assembly, further comprising a second stage thread tensioning device spaced at least 3 meters, along the thread feed path, downstream from the first stage tensioning device and located within 3 meters of a locus where thread traversing the unwind and feed system enters such downstream operation.

In some embodiments, the invention further comprises an operator control station communicating with the thread tension control system, and adapted to send at least one of tension value, enable or disable switch signals, and alarm setpoint values to the thread tension control system, and/or to receive at least one of feedback tension values and status information from the thread tension control system.

In some embodiments, the unwind and feed system is operationally connected into a manufacturing system, the manufacturing system comprises a main controller, the main controller communicates with the unwind and feed system through the operator control station.

In some embodiments, the main controller has an operator interface, and an operator of the manufacturing system can communicate with the thread tension control system, and thereby control the second-stage thread tensioning device, through the operator interface.

In some embodiments, the third and fourth rolling capture devices have axes which are generally horizontal.

In some embodiments, the rolling brake is an electro-magnetic brake.

In a fifth family of embodiments, the invention comprehends an unwind and feed system adapted for overend unwinding of an elastic thread from a package of such thread, and feeding such unwound thread in a downstream direction, along a thread feed path, to a downstream operation, the unwind and feed system comprising a frame, including a thread holder adapted to hold a package of thread; a thread capture assembly located proximate such thread holder, and spaced from the thread holder a distance which facilitates the thread capture assembly capturing a loping thread which is being drawn overend off such package of thread, the thread capture assembly being effective to receive a loping thread from such package of thread and to substantially attenuate transverse movements of such loping thread, the capture assembly comprising a plurality of capture devices, all interaction of such thread with the capture devices comprising such thread contacting only moving surfaces of the capture devices; and a thread tension control system comprising (i) first-stage thread tensioning device proximate and downstream from the thread capture assembly, and (ii) second-stage thread tensioning device spaced at least 3 meters, along the thread feed path, downstream from the first-stage tensioning device and located within 3 meters of a locus where thread traversing the unwind and feed system enters such downstream operation.

In some embodiments, the invention further comprises a plurality of thread guides disposed along the thread path and between the thread capture assembly and the second-stage tensioning device, and all interaction of such thread with the thread guides comprises such thread contacting only moving surfaces of the thread guides.

In some embodiments, the thread guides are adapted to move thread contact surfaces of the thread guides at surface speeds which approximate speeds of movement of such thread.

In some embodiments, the invention further comprises an operator control station communicating with the thread tension control system, and adapted to send at least one of tension value, enable or disable switch signals, and alarm setpoint value to the thread tension control system, and/or to receive at least one of feedback tension values and status information from the thread tension control system.

In some embodiments, the unwind and feed system is operationally connected into a manufacturing system, the manufacturing system comprises a main controller, and the main controller communicates with the unwind and feed system through the operator control station.

In a sixth family of embodiments, the invention comprehends an unwind and feed system adapted and configured to feed thread to an entrance locus of a downstream process at a specified thread tension, the unwind system comprising a frame, the frame comprising a plurality of spool holders adapted and configured to hold spools of thread; and a thread tension control system comprising (i) a first-stage control system proximate the spool holders, adapted and configured to capture thread being drawn from such spools, and to apply an initial controlled level of tension on such thread, and (ii) a second-stage tensioning device, positioned proximate such manufacturing nip, the final tensioning device being adapted and configured to apply a final controlled level of tension on such thread proximate such entrance locus of such downstream process.

In some embodiments, the invention further comprises an operator control station communicating with the thread tension control system, and adapted to send at least one of tension value, enable or disable switch signals, and alarm setpoint value to the thread tension control system, and/or to receive at least one of feedback tension values and status information from the thread tension control system.

In a seventh family of embodiments, the invention comprehends a method of unwinding an elastic thread from a package of such thread in a manufacturing process, and feeding such unwound elastic thread in a downstream direction, along a thread feed path, to a product assembly operation. The method comprises drawing a continuous length of the thread from the package in an overend direction such that the thread leaves the package with a loping action; capturing the loping thread in a thread capture assembly; feeding the thread from the thread capture assembly to a locus where the thread enters the product assembly operation; and applying a terminal tensioning device to the thread so as to reach a desired level of tension in the thread, within 3 meters, along the thread path, of the locus where the thread enters the product assembly operation.

In some embodiments, the terminal tensioning device comprises a second-stage tensioning device applying a second-stage tension, the method further comprising applying a first stage tension to the thread, using a first-stage tensioning device, located proximate the thread capture assembly and at least 3 meters, along the thread path, from the second-stage tensioning device.

In an eighth family of embodiments, the invention comprehends a method of manufacturing a product, using a manufacturing process, including incorporating an elastic thread, at a process entry locus, into the product being manufactured. The method comprises controlling the manufacturing process using a main controller, the main controller having an operator interface; unwinding the thread, from a package of such thread, in an overend direction and feeding the thread along a thread feed path to the process entry locus; controlling tension in the thread by processing the thread through a thread tensioning device; and passing communications, between the thread tensioning device and the main controller, through a secondary controller.

In some embodiments, a human operator can control operation of the thread tensioning device through the operator interface on the main controller.

In some embodiments, the secondary controller translates messages received from the main controller into protocol and/or format which can be read and understood by the thread tensioning device.

In some embodiments, the secondary controller translates messages received from the thread tensioning device into protocol and/or format which can be read and understood by the main controller.

In some embodiments, the secondary controller transmits, and the thread tensioning device receives and responds to, numeric-value message signals.

In some embodiments, at least one of the secondary controller and the main controller transmits to the thread tensioning device, and receives from the thread tensioning device on/off message signals.

In some embodiments, the secondary controller transmits both numeric value message signals and on/off message signals.

In a ninth family of embodiments, the invention comprehends a method of unwinding an elastic thread from a package of such thread in a manufacturing process, and feeding such unwound elastic thread in a downstream direction, along a thread feed path, to a product assembly operation. The method comprises drawing a continuous length of ht thread from the package in an overend direction such that the thread leaves the package with a loping action; capturing the loping thread in a thread capture assembly wherein the thread engages only moving surfaces; and feeding the thread from the thread capture assembly to the product assembly operation at an entry locus.

In a tenth family of embodiments, the invention comprehends a method of unwinding an elastic thread from a package of such thread in a manufacturing process, and feeding such unwound elastic thread in a downstream direction, along a thread feed path, to a product assembly operation. The method comprises drawing a continuous length of the thread from the package in an overend direction such that the thread leaves the package with a loping action; capturing the loping thread and feeding the thread along the thread path, to the product assembly operation, using only rolling thread guides, except for thread guides in any tension sensor.

In some embodiments, the invention further comprises passing the thread through a tension sensor, and any thread guide in the tension sensor comprises a rolling thread guide.

In some embodiments, the invention further comprises applying a first-stage tensioning device to the thread and thereby developing a first level of tension in the thread proximate the thread capture assembly, and applying a second-stage tensioning device to the thread and thereby developing a second different level of tension in the thread within 3 meters of the entry locus where the thread enters the product assembly operation, the second-stage tensioning device being spaced from the first-stage tensioning device by at least 3 meters along the thread feed path.

BRIEF DESCRIPTION OF THE DRAWINGS

FIG. 4 shows a pictorial representation of a thread capture system, in juxtaposed relationship with first and second spools of thread.

FIG. 5 shows a pictorial view of the thread capture system of FIG. 4, and is taken at the circle "5" in FIG. 4.

FIG. 5C shows a top view of the thread capture system of FIG. 4.

FIG. 5D shows an enlarged top view of the thread capture system of FIG. 5C, without the spools.

Figure 1:
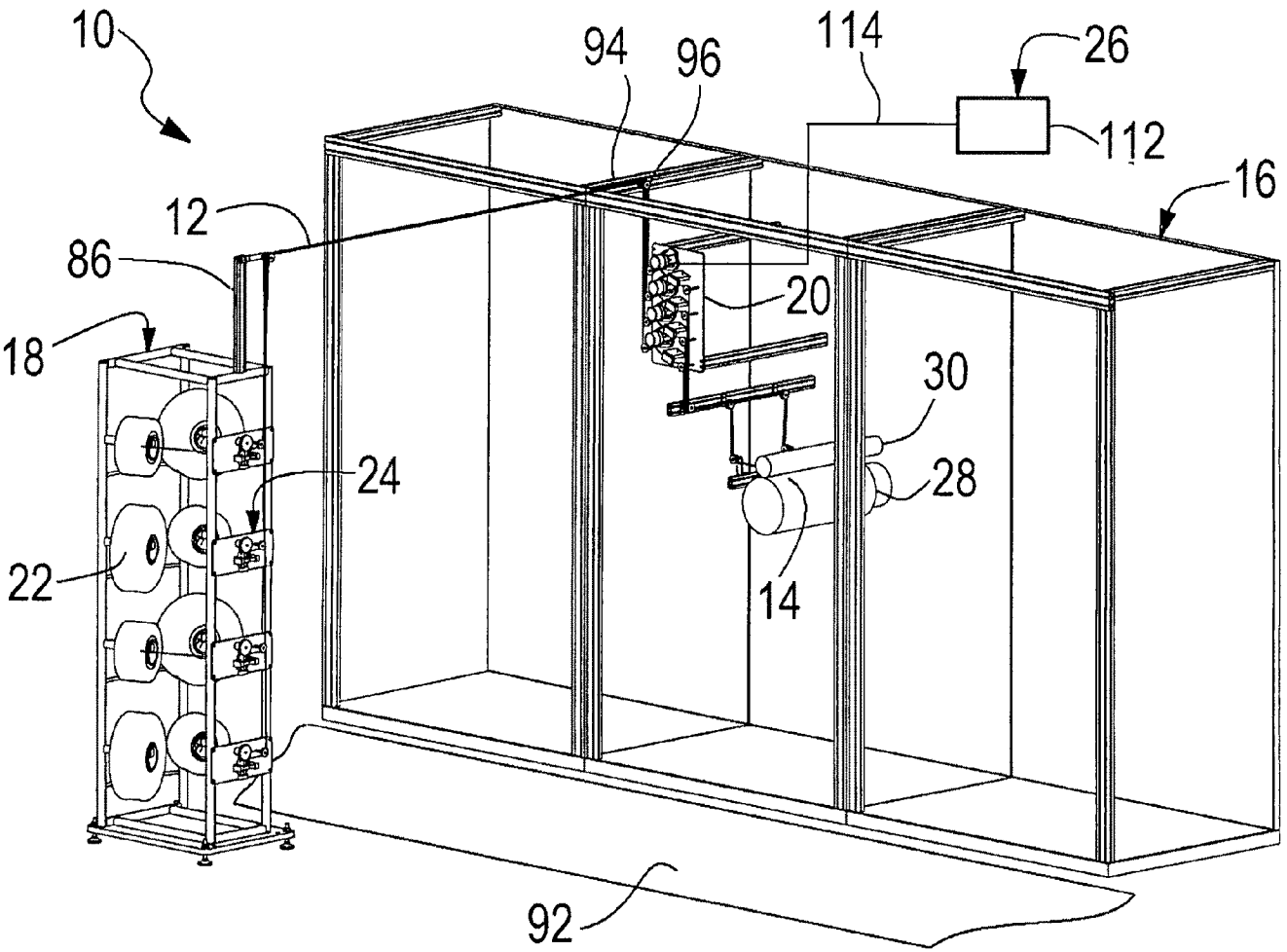
FIG. 1 shows a representative pictorial view of an unwind system of the invention, including unwind creel and first and second tensioning devices, feeding thread into a manufacturing process line at a nip.

The invention is not limited in its application to the details of construction or the arrangement of the components set forth in the following description or illustrated in the drawings. The invention is capable of other embodiments or of being practiced or carried out in other various ways. Also, it is to be understood that the terminology and phraseology employed herein is for purpose of description and illustration and should not be regarded as limiting. Like reference numerals are used to indicate like components.

DETAILED DESCRIPTION OF THE ILLUSTRATED EMBODIMENTS

FIG. 1 illustrates a typical layout of an unwind system 10 of the invention, feeding thread 12 into a nip 14, where the nip represents the location where the thread joins a product assembly operation 16. Unwind system 10 includes a creel 18 and a final tension control system 26. Creel 18 holds a plurality of spools 22 of thread to be unwound and fed into the product assembly operation. Creel 18 has a first-stage control system 24. The primary controlling elements of final tension control system 26 are mounted on a delivery platform 20. The product assembly operation 16 is generally represented by a first manufacturing process roll 28 and a second manufacturing process roll 30 which collectively define manufacturing nip 14 where threads treated according to the unwind system of the invention enter the product assembly operation.

Figure 2:
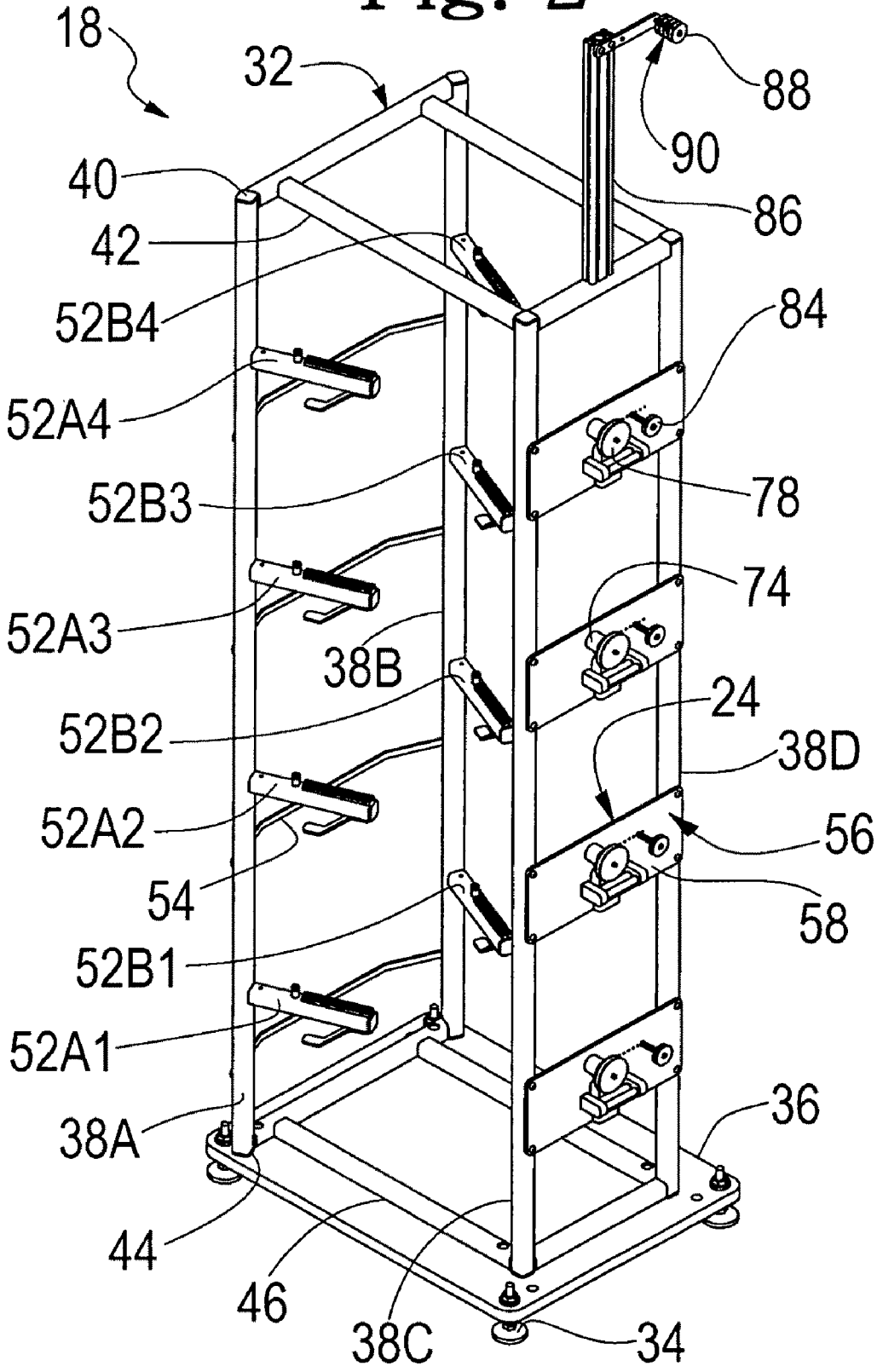
FIG. 2 shows a pictorial view of an empty unwind creel like that shown in FIG. 1.
Figure 3:
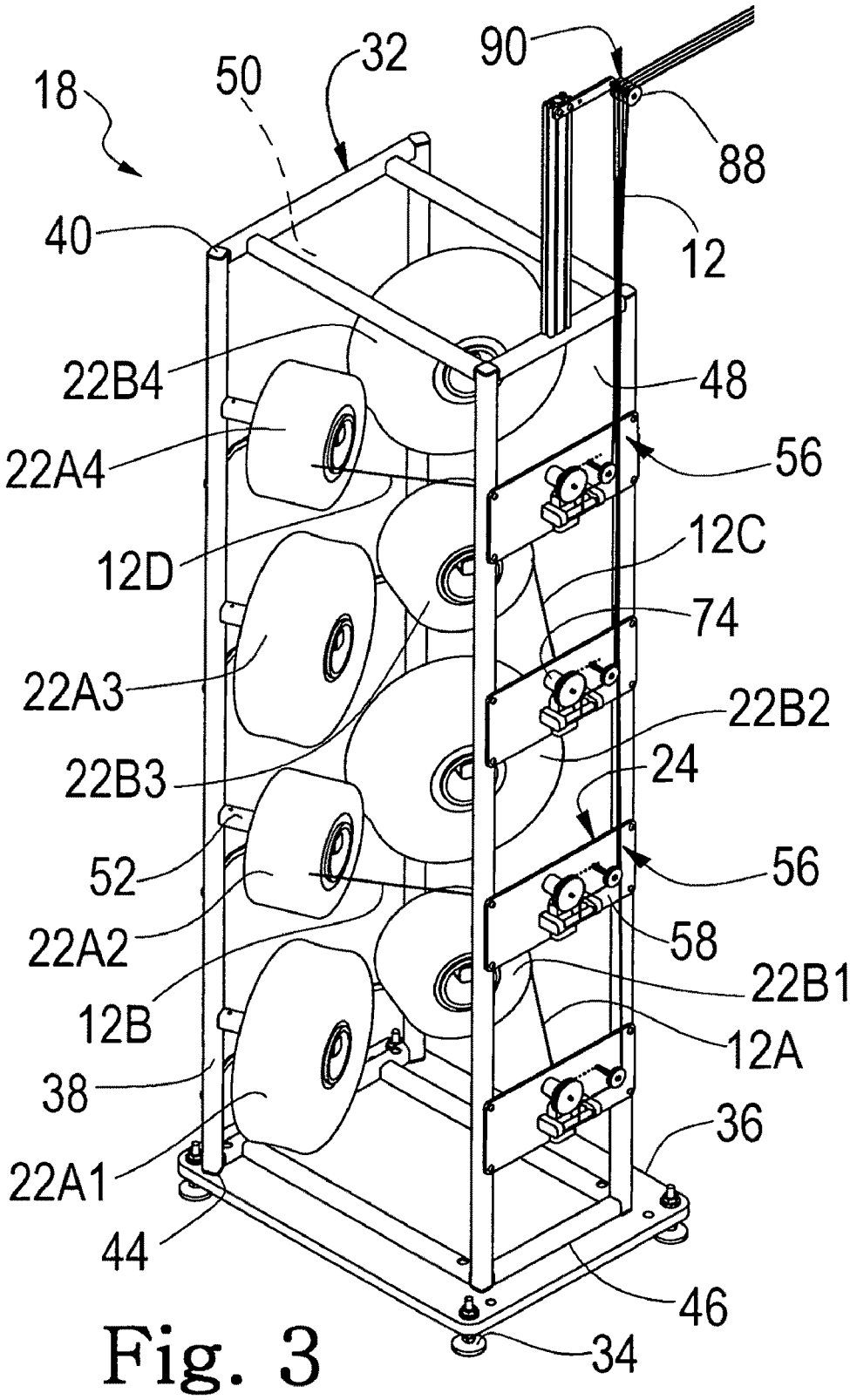
FIG. 3 shows an enlarged pictorial view of the unwind creel seen in FIG. 1.

Turning now to FIGS. 2 and 3, creel 18 has a metal e.g. steel frame 32 which is supported from the floor or other underlying surface by a plurality of feet 34 which are individually adjustable in height, so as to enable leveling the creel as desired. Frame 32, as illustrated, includes an underlying base plate 36 which provides a low center of gravity for the creel, thereby to provide vertical stability to the creel. A plurality of upright supports 38 extend upwardly from the base plate to the upper ends 40. Supports 38 are connected to each other at their respective upper ends 40 by a plurality of top braces 42. Upright supports 38 are connected to each other at their respective lower ends 44 by a plurality of bottom braces 46. Top braces 42 and bottom braces 46 are typically welded or otherwise rigidly mounted to upright supports 38. Upright supports 38 and/or bottom braces 46 are typically welded or otherwise rigidly mounted to base plate 36. Thus the assembled combination of base plate 36, upright supports 38, top braces 42, and bottom braces 46 provides a high degree of rigidity to frame 32, thereby to provide a rigid base of support onto which to mount the spools 22 of thread and first tensioning device 24.

Creel 18 can be thought of as having a front 48 and a back 50. The back of the creel includes the back left upright support 38A and the back right upright support 38B. The front of the creel includes the front left upright support 38C and the front right upright support 38D. Each of back upright supports 38A, 38B supports four spool holders 52.

Referring now to FIGS. 2 and 3, the lower spool holder 52A1 on back left upright support 38A holds a full reserve spool 22A1 of thread while the lower spool holder 52B1 on back right upright support 38B holds an active spool 22B1 from which thread 12A is illustrated as being actively fed. Thus spool holders 52A1 and 52B1 represent a first lowermost tier of spool holders which trade off with each other in the sense that when the active one of the two spools is empty the thread feed is automatically transferred to the reserve spool whereby the reserve spool becomes the active spool and the empty spool is replaced by an operator. The tail of the feeding thread on the active spool is tied to the thread lead on the reserve spool. The two spool holders and spools thus work together to ensure that a first thread 12A is always available for feeding into the product assembly operation.

Similarly, spool holders 52A2 and 52B2 represent a second tier of spool holders, and work with spools 22A2 and 22B2 to ensure constant availability of a second thread 12B for feeding into the product assembly operation. Spool holders 52A3 and 52B3 represent a third tier of spool holders, and work with spools 22A3 and 22B3 to ensure constant availability of a third thread 12C for feeding into the product assembly operation. Spool holders 52A4 and 52B4 represent a fourth upper-most tier of spool holders, and work with spools 22A4 and 22B4 to ensure constant availability of a fourth thread 12D for feeding into the product assembly operation.

A plurality of back braces 54, one at each tier of spools, on creel 18 (i) add further rigidity to the creel frame, (ii) provide a partial barrier to unintentional entrance of a foreign object into the creel from the back side of the creel, and (iii) hold the tied leading and trailing ends of the respective active and reserve spools on a given tier.

Turning now to FIGS. 3, 4, 5, 5A, 5B, and 5C, a plurality of thread capture assemblies 56 are mounted to the front of creel 18. Each thread capture assembly is defined by a mounting platform 58, a first pair of rollers 66, and at least one of a second pair of rollers 70 which are oriented perpendicular to the rollers 66. Rollers 66 and 70 are mounted to the mounting platform. A magnetic brake 74, braking wheel 80, and a turning wheel 84 are also mounted on the mounting platform.

A first one of the thread capture assemblies 56A cooperates with spools 22A1 and 22B1 in capturing the thread 12A which is fed from the respective spool 22A1 or 22B1. Thread capture assembly 56A is supported from front upright supports 38C and 38D by a mounting platform 58. Mounting platform 58 has a front surface 60 which faces frontwardly of the creel, and a back surface 62 which faces in a backwardly-oriented direction, thus facing toward the spools of thread. A central aperture 64 (FIG. 5) extends through the mounting platform from the front surface to the back surface. A first pair of vertically-oriented and generally identical upright rollers 66 is mounted closely adjacent front surface 62 of mounting platform 58 by end-closing brackets 68. The two rollers 66 extend in parallel directions and are positioned closely adjacent each other. Each of rollers 66 is located at generally the same distance from front surface 60 of mounting platform 58. Rollers 66 are of the same diameter and their axes are in a common imaginary plane which is parallel to front surface 60 of mounting plate 58. The opposing ends of both rollers 66 are received in brackets 68. Brackets 68 extend between the respective ends of the rollers 66 and are mounted to mounting platform 58.

A second pair of horizontally-oriented rollers 70, generally identical to rollers 66, is mounted closely adjacent, and frontwardly of, the first pair of rollers 66 by end-closing brackets 72. The two rollers 70 extend in parallel directions and are positioned closely adjacent each other. In the illustrated embodiment, rollers 70 are of the same diameter, each as the other, and their axes are in a common imaginary plane which extends generally horizontally, and perpendicular to front surface 60 of the mounting plate. The opposing ends of both rollers 70 are received in brackets 72. Brackets 72 extend between the respective ends of the rollers 70 and are mounted to platform 58.

In the illustrated embodiment, rollers 66 and rollers 70 are all of common specification, including for example and without limitation, common diameter, e.g. 0.5 inch (13 millimeters), common length, e.g. 2.5 inches (10 centimeters), common material of construction, e.g. ceramic, common suspension bearings, and the like. Thus, a thread 12 experiences similar surface effects and resistances in traversing any of rollers 66, 70. In the alternative, horizontal rollers 70 are of e.g. lesser diameters, than rollers 66 so as to achieve reduced stopping inertia. Horizontal rollers 70 can also vary in other particulars from rollers 66 so long as the collective set of rollers 66 and 70 effectively capture the loping thread.

Figure 5A:
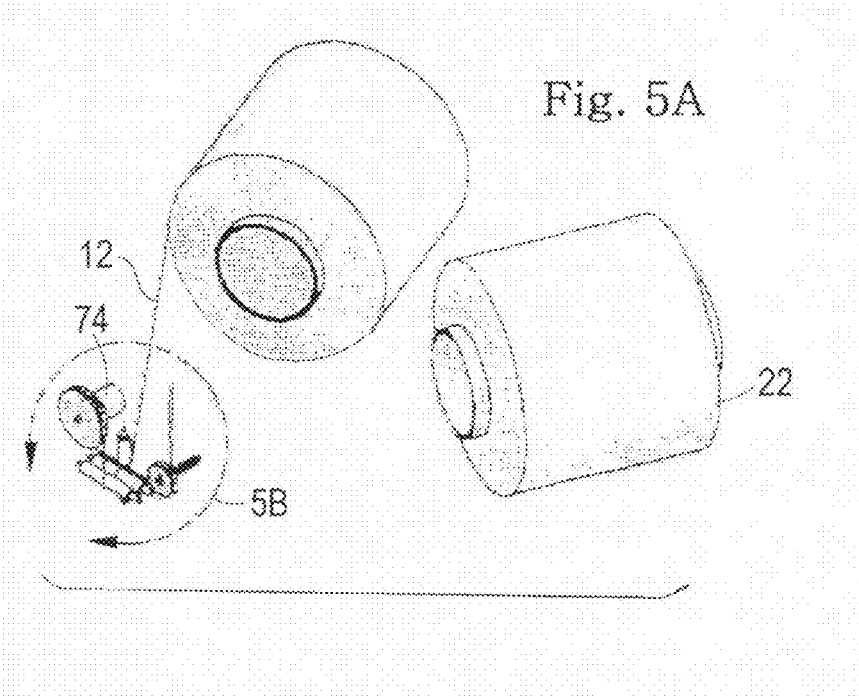
FIG. 5A shows an enlarged pictorial view similar to that of FIG. 5 but without the mounting platform and with representation of first and second spools of thread juxtaposed in working position relative to the thread capture system.
Figure 5B:
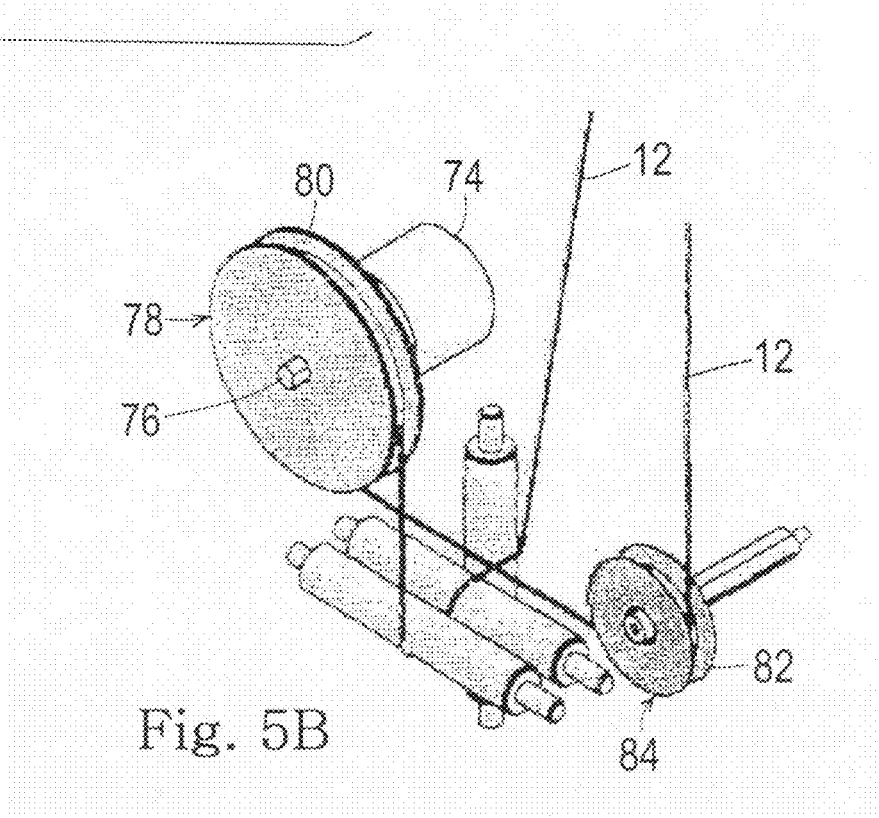
FIG. 5B shows a pictorial view of a thread capture system of the invention, without the mounting platform and without the spools of thread.
Figure 5E:
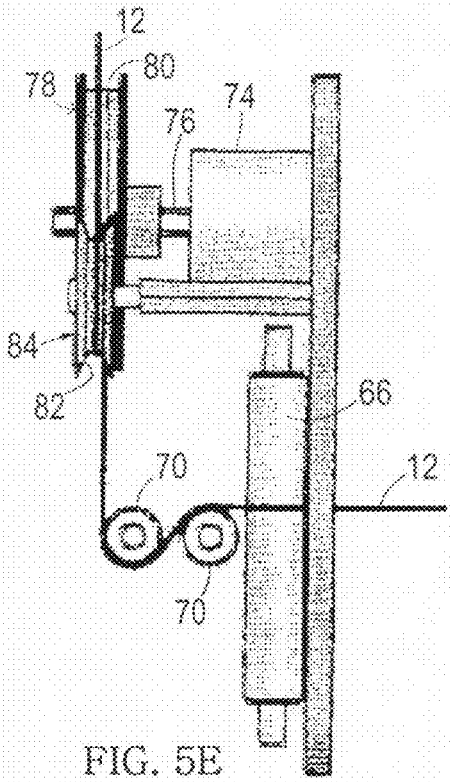
FIG. 5E shows an enlarged side elevation view of the thread capture system of FIGS. 5C and 5D.

Referring now to FIGS. 5B and 5C, an adjustable magnetic hysteresis brake 74 is mounted to the front surface of mounting platform 58. As illustrated in FIG. 5E, brake 74 has an output shaft 76 extending frontwardly, and in a horizontal orientation, from brake 74. A braking roller/wheel 78 is mounted to shaft 76, for rotation with shaft 76. Braking wheel 78 has a groove 80 at its outer circumference. Groove 80 receives and guides a thread which traverses the wheel. In the illustrated embodiments, groove 80 resides in a vertical plane which extends upwardly from approximately a front-most tangent to the front-most one of horizontal rollers 70.

A groove 82 in grooved turning wheel 84 resides in an imaginary plane which is slightly displaced, away from mounting plate 58, relative to wheel 78, such that a thread traversing wheel 78 can, in general, travel to and traverse groove 82 without touching the thread which is feeding into wheel 78. In order to accomplish such thread-to-thread clearance when the thread is under tension, groove 82 is sufficiently narrow at its control depth to provide the required degree of lateral thread control.

A separate thread capture assembly 56 is provided for each tier of spools, accordingly for each thread which is to be drawn/unwound from creel 18 and fed to manufacturing line 16. Thus, in the embodiment illustrated in e.g. FIG. 3, four thread capture assemblies are provided to capture and control simultaneous traverse of four threads 12 from creel 18.

A mast 86 extends upwardly from the front top brace in creel 18. Four turning wheels 88 (FIG. 2) are mounted on a turning wheel assembly 90 which is mounted at the top of mast 86. Turning wheels 88 are mounted so as to have axes of rotation oriented so as to turn threads 12 coming from the respective turning wheels 84 in a desired direction. In the illustrated embodiments, the axes of turning wheels 84 are oriented horizontally, and turn threads 12 across the aisle or walkway 92 which passes between creel 18 and manufacturing line 16.

Delivery platform 20, and thus final tension control system 26, is mounted to a machine or other support on the manufacturing line, in close proximity to the nip 14 where the thread enters the product assembly operation as an element in the goods being manufactured on the manufacturing line. Thus, tension control system 26 can be mounted on a stand-alone support frame, can be mounted on the frame of a machine already existent in the manufacturing line, or can be mounted on any other convenient support available at the desired location.

A second mast 94 can extend upwardly above delivery platform 20 to approximately the same elevation as mast 86 on creel 18. Mast 94 typically is not mounted to delivery platform 20. Rather, mast 94 is typically mounted to a frame somewhere in the vicinity of delivery platform 20, and may be mounted on the same frame or machine on which the delivery platform is mounted.

Four turning wheels 96 are mounted on mast 94. In the alternative, and as shown in FIG. 1, the assembly of turning wheels 96 can be mounted directly to structure which is part of one of the manufacturing line machines whereby that structure functions as mast 94. Turning wheels 96 are mounted so as to have axes of rotation oriented so as to turn threads 12 coming from first mast 86 in a desired downward direction so as to deliver the threads to final tension control system 26. In the illustrated embodiments, the axes of turning wheels 96 are oriented horizontally, so as to accomplish the downward turn of the threads coming across aisle 92.

Figure 6:
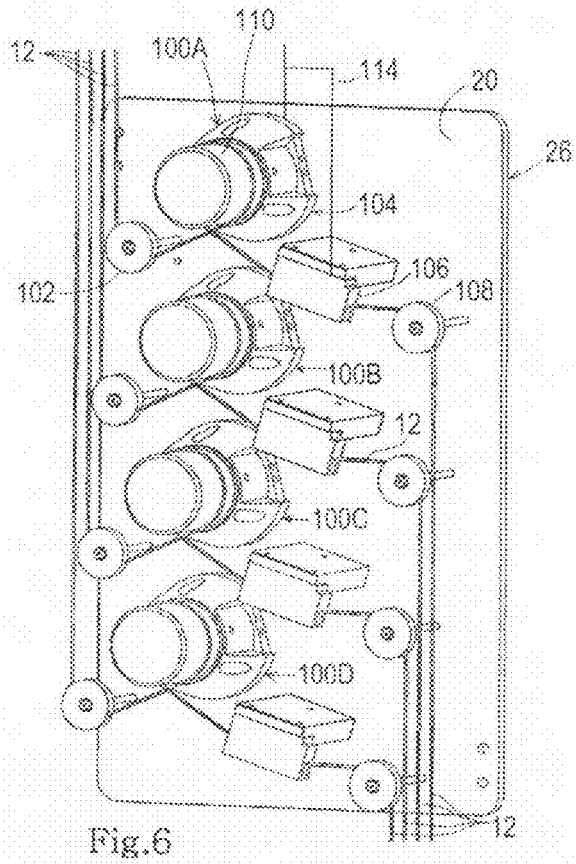
FIG. 6 shows an enlarged pictorial view of the final tensioning device.

Turning now to FIG. 6, four final tension assemblies 100A, 1008, 100C, 100D are mounted to delivery platform 20. Each final tension assembly 100 includes an incoming turning wheel 102, a tensioning device 104, a tension sensor 106, and an outgoing turning wheel 108.

Turning wheels 102 and 108 are conventional grooved wheels mounted to delivery platform 20 on e.g. horizontal axes of rotation, and are typically the same types of wheels as are used for wheels 78, 84, and 96, thus to capture and guide a thread arriving from a wheel 96 on mast 94.

In the embodiment illustrated, tensioning device 104 is an actively driven device which expresses output at a rotationally-driven cylindrical outer surface 110. Tension sensor 106 receives a thread passing therethrough, measures the tension on the thread, and reports the tension, or a tension variation, to a control driver 112 (FIG. 1) which computes changes in drive commands and communicates control commands to tensioning device 104 through a wire connection, optionally through wireless communication channels. A wire connection 114 is shown to controller 104 and sensor 106

A suitable combination of tensioning device 104 and sensor 106, along with control driver 112, is available as KTF 100RW from BTSR Company, Olona, Italy. The "KTF" system is designed such that tensioning device 104 is actively driven by e.g. a 2-way servo motor so as to be able to increase or decrease tension in the thread as the thread passes through a final tension assembly 100. A braking-only controller 104 can be used as desired in a final tension assembly, but accommodates a smaller range of acceptable incoming tensions on the thread as the thread enters the final tension assembly.

Since a typical manufacturing line where thread control systems of the invention are advantageously employed was designed and set up without contemplating use of a control system of the invention, there normally is not room to position a final tension assembly close enough to the manufacturing feed nip 14 that the thread can be fed directly from outgoing turning wheel 108 to the nip. Accordingly, one or more additional turning wheels, not shown, are typically used to guide the thread from outgoing turning wheel 108 to manufacturing nip 14. While choosing to not be bound by example, typically no more than 2 such turning wheels are used between outgoing turning wheel 108 and nip 14.

Typically, the distance between outgoing turning wheel 108, on delivery platform 20, and nip 14 is no more than about 3 meters, optionally no more than about 2 meters, and is commonly about 0.5 meter to about 2 meters. The distance between sensor 106 and outgoing turning wheel 108 is typically a matter of a few inches, such as about 1 inch to about 5 inches. Similarly, the distance between tensioning device 104 and sensor 106 is a few inches, such as about 1 inch to about 5 inches. By placing a second and final tension control assembly close to the manufacturing nip, the invention provides a substantially more uniform, and more predictable, tension on the thread as the thread enters the manufacturing nip. The tension on the thread entering the product assembly operation such as at nip 14 is more predictable, and has fewer variations and smaller variations. The thread thus enters the product assembly operation, including entering the product precursor, with a greater level of uniformity of tension, whereby the manufacturer obtains more control, tighter tolerances over variations in the elongation and retraction properties in the manufactured product.

The unwind system of the invention operates as follows. Referring to FIGS. 1, 4, and 6, a leading end of a thread 12 is drawn from a spool 22 which is mounted on creel 18, and threaded through the thread capture assembly which is mounted on the respective tier of the creel. Thus, the thread is threaded between vertical rollers 66, over the first horizontal roller 70 and under the second horizontal roller 70.

The thread is passed, from the distal tangential surface of the second horizontal roller 70, upwardly and into a tangential relationship with the closest lateral edge of wheel 78 on shaft 76 of the hysteresis brake. The thread is seated in groove 80, wrapped approximately 270 degrees around wheel 78 in a counterclockwise direction as seen in FIG. 4, and passed horizontally away from wheel 78 and into tangential wrapping contact with a lower surface of turning wheel 84. The thread is wrapped about 90 degrees about turning wheel 84, turning the direction of the thread from horizontal to upward. The thread is then drawn upwardly to turning wheel assembly 90, about one of wheels 88, thence horizontally across the aisle 92 at an elevated height, to and about one of turning wheels 96, thence downwardly to one of turning wheels 102. The thread traverses a turn in direction of about 90 degrees to about 135 degrees on turning wheel 102, and traverses thence to the respective driven tensioning device 104.

The thread is threaded typically about 270 degrees to about 310 degrees, optionally more or less, about outer surface 110 of the respective driven tensioning device. The gripping, friction characteristics of the outer surface of the tensioning device are designed, adapted, and configured to be able to grip the contemplated thread to be controlled in the tension environment employed as the thread enters the manufacturing nip. From the tensioning device 104, the thread is threaded through tension sensor 106, thence to outgoing turning wheel 108. Now referring to FIG. 1, from turning wheel 108, the thread is typically threaded over, under, around, and/or through one or more additional thread guides in aligning the thread for a non-disruptive entrance into manufacturing nip 14.

Advantageously, threading eyes 118 or the like can be used adjacent entrance and/or departure loci of any of the various rolling thread guides downstream of rollers 70. The function of such threading eyes 118 is to hold the thread on the respective adjacent thread guide when the thread is slack, such as when the thread is initially threaded from a spool 22 to nip 14. However, such threading eyes are carefully positioned such that the travelling thread, under designed operating tension, does not touch such threading eyes as the thread is being drawn along the thread path from a spool 22 to nip 14. An exemplary such threading eye is shown as a pigtail eye 118, adjacent the in-feed locus of wheel 78 in FIG. 5.

Additional threads are so threaded, according to the design of the product being manufactured on the manufacturing line, along similar paths up to nip 14.

The threading can be done without application of any power to any of the machines. Indeed, no power need be connected to creel 18. Once all of the threads to be employed at a given time have been so threaded, power is applied to the driven roll in nip 14 causing a slowly driven rotation of the nip rolls, whereupon the threads are fed into the manufacturing nip. As the threads are advanced into the manufacturing nip created by the slowly turning rolls, the threads are drawn into the nip, thereby completing the threading process.

Once a thread has been captured at nip 14, any further advance of the rolls of nip 14 imposes a draw on the thread, and progressively draws the thread into and through the nip, and thus into the manufacturing process. With the threads now in the nip, and responsive to driving of the rolls at the nip, the manufacturing operation is started up, including progressively and continuously drawing the threads into and through the nip.

As thread is drawn through nip 14, the slack is taken up and the elastomeric thread stretches, to the point where the stretching force transfers all the way back along the path of travel of the thread, to the respective spool. As the draw force increases in accord with rotation of the rolls at nip 14, the draw on the thread eventually becomes sufficiently great to cause additional thread to be drawn from the spool. As the thread begins to pass over the respective rollers and wheels, the wheels and rollers take on their dynamic functions and begin to rotate. Further, as the thread comes up to operating tension, the thread loses all contact with any static threading eyes or other threading structures. As wheel 78 begins to rotate, the magnetic force in brake 74 begins to apply a braking force on wheel 78, thus applying a braking force on the respective thread 12.

As the thread begins to come off the active spool at an increasing rate, the thread coming off the spool begins to form what is known as a loop shape, hoop shape, jump rope shape, or balloon shape, which is associated with the drawing of the thread from about the circumference of the non-rotating, static spool. As the ballooning thread approaches aperture 64, the confining configuration of rollers 66 and rollers 70 dampens and suppresses the loping activity of the thread. Thus, the combination of upright rollers 66, horizontal rollers 70, and the tension on the thread, dampens the ballooning movement of the thread at first-stage control system 24, and takes captive the direction of advance of the thread. Namely, the rollers 66 capture and control lateral movement of the thread, such that the thread arriving at the first-to-be-encountered roller 70 still embodies substantial vertical movement, but little, if any, lateral horizontal movement. Given the tension on the thread, the first-to-be encountered horizontal roll 70 captures and eliminates substantially all of the remaining vertical movement, whereby substantially all of the both vertical and the horizontal lateral movements of the thread coming off the spool are captured and nullified. The rollers 66, 70 thus channel the thread to advance in the direction of desired thread advance.

In, for example, FIGS. 5A and 5B, only a single vertically-oriented roller 66 is shown so that the path of the thread can more easily be seen. However, the second roller is used, as illustrated in FIG. 5C, in order for first-stage control system 24 to provide initial lateral control of movement of the thread both when thread is drawn from the right spool (FIG. 5C) as well as when thread is drawn from the left spool.

The typical uncoated elastomeric fiber thread contemplated for use in this invention is uncoated spandex, which is quite tacky, such that the threads on a spool stick together. Thus, a thread on the surface of the spool is lightly held in its place by the combination of underlying threads, a small amount of tension, and optionally by laterally adjacent threads. Since even the threads on the surface of the spool of thread are not necessarily loose on the spool, drawing the thread from the spool requires a certain amount of force. For an as-spun spool of uncoated spandex thread, about 5 grams to about 20 grams of force are required to draw the thread from the spool. For a rewound spool of uncoated spandex thread, a lesser amount of force, such as about 2 grams of force, are required to draw the thread from the spool.

The instantaneous force required to take an incremental length of thread off the spool varies as the locus of attachment of the thread to the spool advances about even a single wrap of the thread about the spool. Typical force variations can range from as little as no force/tension where the thread is not attached at all, to up to about 30-40 grams of force. The tension in a given roll, and from roll to roll varies in accord with the composition of the spandex thread, any processing material on the surface of the thread, the processing conditions under which the thread was deposited in the spool, and the environmental conditions to which the spool has been exposed since manufacture. Average tension, when drawing e.g. 680 decitex uncoated spandex from a typical commercially-available spool of thread is, for example and without limitation, for an e.g. 10 minute test, about 6 grams at the outside of a full spool, to about 12 grams as the residual thread being drawn approaches the spool core.

The purpose of the invention is to capture and control these substantial variations in tension, and the ballooning activity of the thread as the thread is being drawn from the spool, and to focus the energy in the thread, and the direction of travel of the thread, so as to feed the thread into nip 14 at a constant tension, consistent with the instantaneous needs of the manufacturing operation as expressed at the manufacturing nip. By controlling tension in the thread closely adjacent the nip, the user is assured of a more consistent feed of thread into the product assembly process so as to produce consistently-tensioned finished product exiting the manufacturing operation. Namely, since the tension of the thread going into the nip is effectively controlled, and maintained close to a target thread tension, the retraction properties of the finished product which uses such stretched thread can be more precisely targeted to the desired retraction properties, and product can be manufactured with less variation in retraction properties over a given population of the finished product.

By providing a separately defined path of travel for each thread, and by guiding only one thread with each thread guide, whether it be a roller or a wheel, a tensioning device, or a tension sensor, the tension of each thread can be separately monitored and controlled, such that a different thread tension can be targeted and obtained for any one thread, or for different groups of threads. Thus, each thread can be individually controlled such that the tension on the thread as the thread enters nip 14 can be controlled so as to be predictably different from the tension on any one or more of the other threads which are simultaneously being fed into nip 14. Similarly, each thread can be individually controlled such that the tension on the thread as the thread enters nip 14 can be controlled so as to be predictably the same as the tension on any one or more of the other threads which are simultaneously being fed into nip 14.

A typical path of travel from spool 22 to nip 14, typically across an aisle 92, is about 5 meters to about 20 meters, optionally about 10 meters to about 20 meters. Thread 12 necessarily traverses a number of roller guides and/or wheel guides along its path of travel, each of which adds its incremental but rather nominal drag contribution to the tension already on the thread.

As the thread approaches thread capture assembly 56, the tension on the thread has historically, and using technology of the prior art, been about 2 grams to about 40 grams of force, and typically averages about 6 grams to about 12 grams.

An exemplary magnetic brake 74 useful in the invention is a 513 series permanent magnet hysteresis brake available from Magnetic Technologies, Oxford, Mass. Such brake requires no external energy source and operates entirely on the basis of the energy expressed by the magnet forces generated internally by rotation of the brake. Thus, as the thread is drawn about wheel 78, wheel 78 begins to rotate, thus rotating shaft 76 and thus the internal mechanism of brake 74. As the internal mechanism of brake 74 turns, the electromagnetic flux of the brake magnet exerts a retarding force urging retardation of the speed of rotation of shaft 76, and thus wheel 78. This retarding force applies a braking force to retard advance of the thread, with the result that the tension on the thread as the thread leaves wheel 78 is desirably about 50 percent to about 80 percent of the final tension which is desired of the thread as the thread enters the manufacturing nip. If the actual tension is not within the desired range of tensions, a 513 series such brake can be manually adjusted to bring the tension of the thread leaving the brake into the specified range.

The actual desired tension leaving wheel 78 can and does vary depending what other drag forces are exerted on the thread as the thread traverses the path of travel from spool 22 to nip 14. For example, a rolling contact exerts less drag than a static contact. A dirty bearing on a rolling contact exerts more drag than a rolling contact which has a clean bearing. A tacky or high-friction thread-contacting surface on either a rolling contact or a static contact exerts more drag than a clean surface. At least dirt and friction drag factors can change during a thread feeding operation.

In the illustrated embodiments, and as a characteristic feature of unwind systems of the invention, all thread contacts with the exception of the recited sensor 106, but including all thread guides, present rolling contact surfaces to the thread. Thus, all thread contact is a rolling surface contact, thereby applying only minimal resistance, drag on the thread as the thread advances along its path of travel.

This is in stark contrast with prior art unwind systems which guide the thread under tension through one or more static thread-directing guides which are routinely in constant contact with the thread as the thread is being drawn under tension, including in some cases after the thread has passed a tensioning device on the creel, whereby the tension on the thread as the thread leaves the tensioning device on the creel is no more than about 40 percent of the final tension, with the remaining tension being added by the uncontrolled and unpredictable friction of the turning devices which are arrayed along the thread path.

Since, in the invention, a reduced amount of drag is imposed on the thread by the rolling thread contacts, since the tension desired at manufacturing nip 14 is independent of any tension experienced by the thread ahead of the manufacturing nip, a higher amount of tension can be applied to the thread at creel brake 74 without exceeding safe thread tension limits downstream of the brake, along the thread path.

Thus, higher target thread tension levels of about 50 grams to about 80 grams can be applied in the invention as the thread leaves the creel with an exemplary 680 decitex thread where the target tension going into nip 14 is about 100 grams to about 110 grams. Thus, the rise in tension between brake 74 and tensioning device 104 is typically less than 110−50=60 grams, optionally less than 110−80=30 grams for such 680 decitex thread.

Given the higher relative tension which can be applied to thread 12 as the thread leaves the creel, the operator can achieve more precise control of the thread as the thread traverses the path toward tensioning device 104, where the final tension level is applied to the thread. Thus, first-stage tensioner 74 does more than simply damp out major tension spikes in the thread. The higher tension between the first and second-stage tensioners can better absorb slack in the thread which occurs as the thread comes off the spool. Further, since additional tension can be applied to the thread at brake 74, and in light of the use of the second stage tensioner, at least some of the additional tension applied by brake 74 extends along the thread to the second-stage tensioner, whereby both sudden increases and sudden decreases in tension in the thread anywhere along the thread path between the first and second tensioners, can be more readily absorbed in the feed system.

Returning now to further brief discussion of thread capture assembly 56, the reduced drag on the thread at rollers 66, 70, as compared to a static eye, imposes a reduced level of drag on thread 12, and the thread has less tendency to stick to the surface of the respective guide member, as the thread enters the capture assembly. Given the reduced tendency to stick on the capture assembly member, given that all contact at the capture assembly is rolling contact, the thread passes through the capture assembly up to brake 74, wheel 78, with less drag on the thread, whereby the angle-related limitation on location/angle of the spool, as expressed in e.g. U.S. Pat. No. 6,670,054 Heaney et al, is not important, in the instant invention, to the ability to get thread 12 through the thread capture process without breaking the thread. Rather, any angle which can effectively feed the thread to rollers 66 is acceptable in the invention.

Similarly, the distance limitations expressed in Heaney et al '054 are no longer limitations on the ability to feed thread to the capture assembly without breakage of the thread. Further, the degree of tackiness, as expressed in Heaney et al '054, is not a factor in ability of the thread to be captured by capture assembly 56.

Accordingly, the only limitation on distance between the closest portion of the spool of thread and the capture assembly is that enough room must be provided for front-mounting the spool on a spool holder 52. Indeed, where the spool holder is designed and configured to be detachable from its upright support 38 for mounting of a spool on the spool holder, the distance between the front of the spool and rollers 66 can be as little as, in some instances, about 0.2 meter. Distances of 0.25 meter, 0.30 meter, 0.35 meter, and 0.38 meter, and, all distance increments in between, all of which are less than the distances contemplated by Heaney et al '054, are all possible and contemplated for use in the invention. The greater distances, which are limits in the prior art, and which are practiced in the prior art, are not limits in the invention, but can be employed if and as desired.

Regarding the spool angle, while an angle larger than those recited in the prior art can be used, for purposes of efficiently using manufacturing floor space, the creel is kept as compact as practical, whereby the angle between a projected axis of aperture 64 and the axes of the respective spools 22 is typically about 22 degrees, as illustrated generally in FIG. 5C.

While the creel as illustrated herein shows capacity for feeding four threads simultaneously, and a total of eight spool holders, the creel can be expanded both laterally and vertically to accommodate a greater number of spools on the creel, and a corresponding greater number of threads being fed simultaneously. Similarly, as desired, the spool capacity can be reduced if desired to handle fewer than 4 threads and 8 spools. In general the ratio of the number of spools which can be held on the creel is twice as great as the number of threads which are to be fed simultaneously. Thus, for each thread being fed, one active spool will be feeding the thread, and an adjacent spool holder is available to hold the reserve spool to which the feeding is transferred automatically when the active spool is empty.

If and as desired, brake 74 can be an actively and externally energized driven brake rather than a passive brake energized only by magnetic forces emanating from a permanent magnet.

As mentioned earlier, all thread guides and controls, except for the exemplary tension sensor, are rolling devices. The sensor above mentioned from BTSR Italy does employ static guides in collecting tension data for feed to control driver 112. If and as desired, a sensor having rolling guides can be used instead, whereby all of the guides and other thread contacts are rolling contacts.

It is noted that, in the invention, the capture assembly uses two pairs of rollers 66, 70, on perpendicular axes, both axes being perpendicular to the direction of travel of the thread, to serve as a balloon damper, thus to dampen out the loping, jump-roping ballooning of the thread, and thereby to capture and tame the lateral movements and tension spikes in the thread and to bring the thread under control for further processing of the thread according to direction of travel and quantity and intensity of tension variations.

By using only rolling contacts so that the tension leaving the creel can be e.g. 50 to 80 grams, an increased level of control is exerted over tension variations in the thread. Namely, the ability to hold tension in the thread at a higher level for a longer distance provides an increase in the ability to control, and dissipate, tension spikes which enter the thread as the thread is being drawn off the spool. So, while the thread in the invention starts along its path from the spool with a conventional quantity of tension variations and spikes, the ability to apply increased level of tension to the thread, over a longer distance, compared to conventionally known technology, gives greater control of tension leaving the creel. By adding a second tensioning device proximate the entrance of the thread into the manufacturing process, control of thread tension becomes less dependent on what happens to the thread up-stream of the second tensioning device, and more dependent on the actual tension imparted to the thread by the second tensioning device.

So to some extent, the increased tension upstream of a final tension assembly 100 is less important to the final tension and largely used to get better, more positive control of the thread so as to prevent the thread from e.g. jumping out of the grooves in the respective turning wheels, and the like. Nevertheless, the greater tension level between brake 74 and tension assembly 100 does enable better control of the tracking of the thread along its path of travel.

Accordingly, it is advantageous, as discovered in the invention, to apply a first-stage tension control to the thread close to the thread package/spool 22, in combination with a second-stage tension control close to the manufacturing nip. The first-stage control as at brake 74 provides increased control of the traverse of the thread over the path of travel e.g. across aisle 92 to final tension assemblies 100. The final application of tension control provides precise control of the tension going into the nip, with only minor variations as the thread passes over the last 1 to 3 guides in getting from tension assembly 100 to the nip.

If and where room permits in a product assembly operation to which thread is to be fed, tension assembly 100 is desirably positioned and aligned so as to feed the thread from the tension assembly as at turning roller 108 directly into the nip 14 without the thread encountering any additional thread guides or other contacts.

For effective use of both a first-stage tension control and a final-stage tension control, the two control devices are typically separated by at least 0.25 meters, optionally separated by at least 1 meter, also optionally separated by at least 2 meters, or 3 meters, or more depending on the length of the path from the respective spool 22 to the respective manufacturing nip 14.

As seen above, the invention provides for 2-stage tension control in handling tacky elastomeric thread. Accordingly, a tacky thread can be fed over a path of substantial length, e.g. at least about 10 meters to about 20 meters, with imposition of relatively precise control of the thread tension at and/or adjacent the destination nip where the thread is fed into a product assembly process.

The final tension control as at tension assemblies 100 can be designed and specified to function only as a brake. On the other hand, the tensioning device 104 can be powered by e.g. a servo motor so as to have the ability act as either a brake, thereby to increase tension on the thread, or as a drive motor, thereby to decrease tension on the thread. Where the final tensioning device acts only as a brake, it is critical to not add so much tension at brake 74 that the tension in the thread as the thread enters the final tension assembly 100 is greater than target tension for the thread as the thread enters nip 14. If such case were to occur, the final tension assembly 100 would be powerless to correct such excess tension as the final tension assembly, in that case, can only add tension. It cannot reduce tension. Accordingly, for maximum versatility of operations, a driven tensioning device is typically used.

The unwind and feed systems of the invention can be controlled using a variety of control systems. In the simplest control system, an unwind and feed system of the invention can operate as a stand-alone system which does not have any communication with the overall manufacturing process. In such case, thread is fed to the manufacturing process as a response to draw tension generated at nip 14 of the manufacturing operation, starting when the manufacturing operation is started up. In that case, all tension targets, status information such as thread breaks, and the like, are handled manually by an operator who inputs commands at each tensioning device.

As a step in up-grading system control, data and switching commands can be handled by a stand-alone operator control station which can enable an operator to control multiple tensioning devices from a single operator control station. A suitable such interface is available as model HE-XE105 from Horner APG, Indianapolis, Ind. Such stand-alone operator control station can be used to send various commands to multiple tensioning devices; such commands as tension setpoint value, enable/disable switching, and alarm setpoint values. In addition, the operator control station can receive feedback tension values and status information, from which the operator control station can generate alarms. In addition, the operator control station can be used to provide enable/disable commands to any or all of the tensioning devices.

Figure 7:
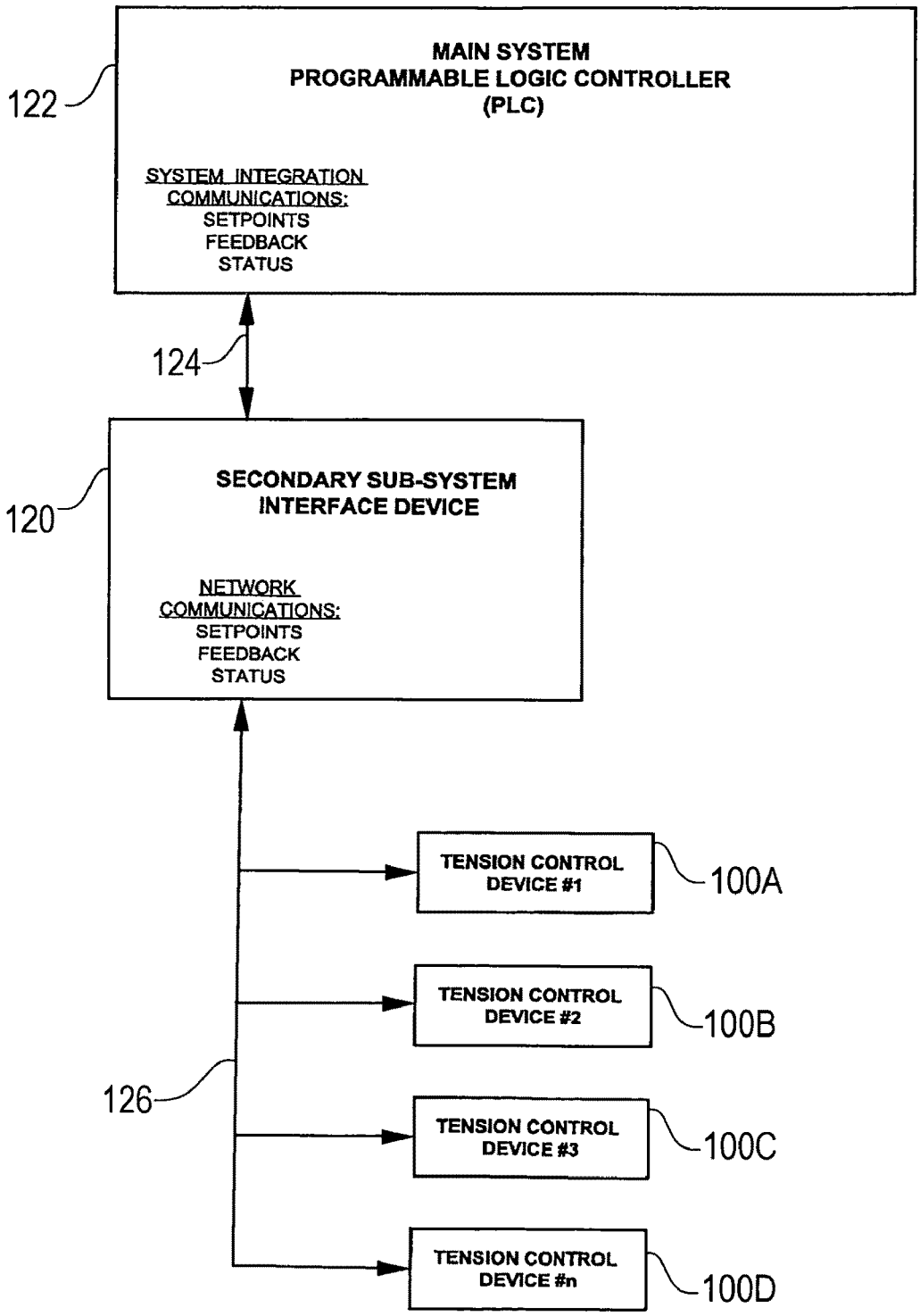
FIGS. 7-10 provide illustrations of four control configurations which can be used in the invention.

Control of the unwind and feed systems of the invention can also be integrated with the overall manufacturing operation by providing communication between the operator control station, as a secondary interface device, and the main PLC which is operating the overall manufacturing operation. A first such integrated communication and control system is illustrated in FIG. 7. In the system of FIG. 7, the operator control station is numbered 120 and the main PLC is numbered 122. Four final tension assemblies 100A, 100B, 100C, and 100D are illustrated. Any desired number of tension assemblies can be used as indicated by the number of threads which are to be fed into the manufacturing operation.

Still referring to embodiments represented by FIG. 7, the operator control station functions largely as a communications facilitator. Operator control station 120 receives a message from the main PLC over a communications link 124, and modifies the protocol and/or the format of the message, for example and without limitation scales the information in the message, organizes the information in the message, or converting units of measure in the information. The operator control station 120 sends the modified message to the tension control assemblies over a serial communications link 126. For example, the main PLC sends setpoint values in a protocol and/or format which cannot be received and understood by the tension control assemblies 100. The operator control interface translates the setpoint values from the PLC into a protocol and/or format which can be read and understood by the tension control assemblies, and sends the modified message to the tension control assembly. Similarly, the tension control assemblies 100 send feedback and status values over communications link 126 in protocol and/or format which cannot be received and understood by the main PLC 122. Operator control station 120 translates the feedback and status values into a protocol and/or format which can be read and understood by main PLC 122, and sends the translated information to the main PLC over communications link 124.

Figure 8:
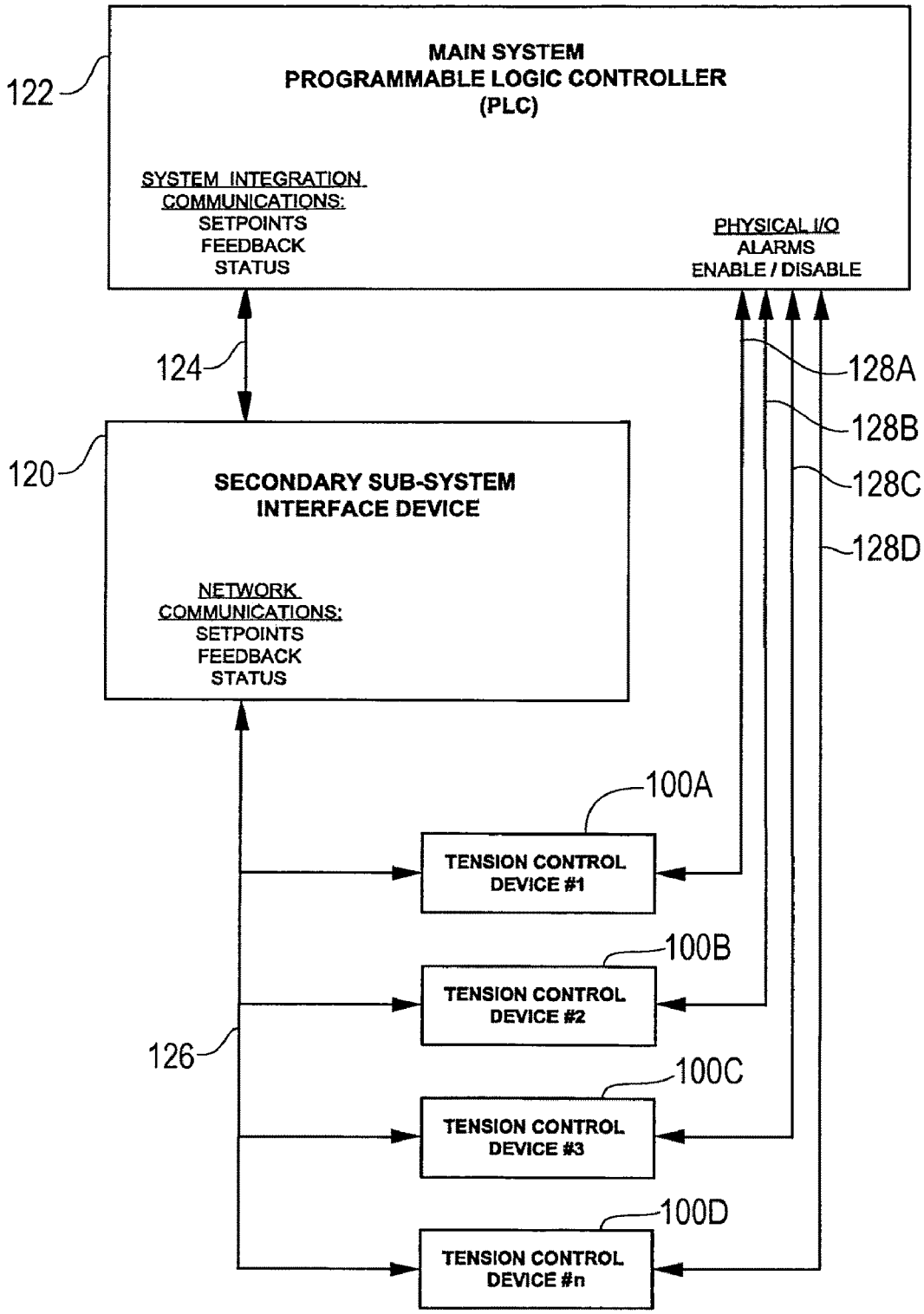

In the embodiments illustrated in FIG. 8, operator control station 120 continues to function in a translation and communications capacity as in FIG. 7. In addition, switching information/commands such as alarm trigger signals and enable/disable signals are fed back and forth directly between the main PLC and the tensioning devices 100A, 100B, 100C, 100D through communications links 128A, 128B, 128C and 128D. Since the information transmitted over communications links 128A, 128B, 128C, and 128D are on/off, switching commands only, no specific protocol and/or format per se is needed to interpret such commands, whereby the translation capabilities of operator control station 120 are not needed, and the communications links can go directly to main PLC 122 without passing through operator control station 120 for translation purposes.

Figure 9:
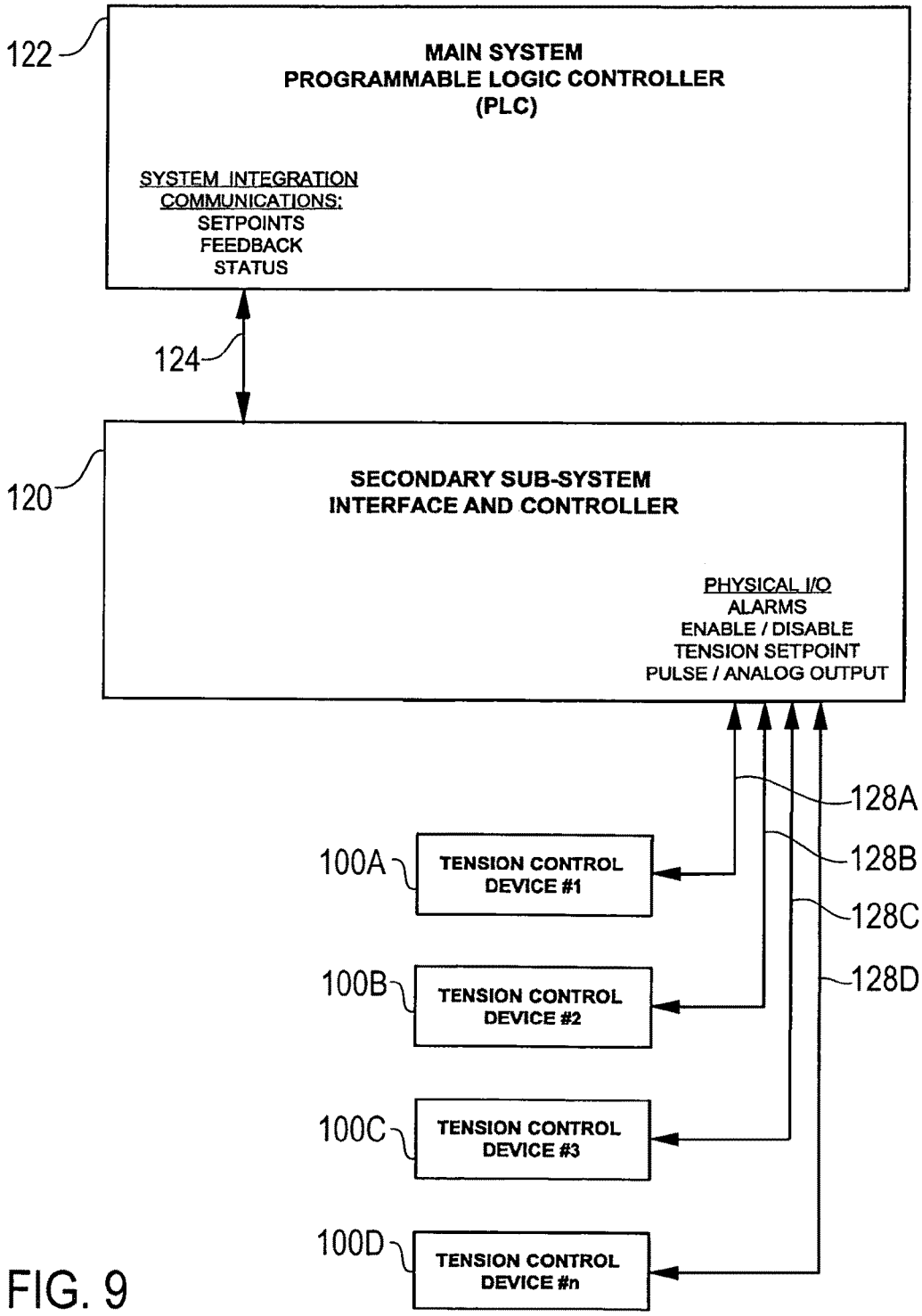

In the embodiments illustrated in FIG. 9, all communications between the main PLC and the tension control assemblies 100 passes through operator control station 120. However, all communications from operator control station 120 to the tension control assemblies is sent as on/off switching signals. The illustrated KTF tension control assemblies have a default tension setpoint. In the embodiments illustrated FIGS. 7 and 8, the main PLC and the operator control station send specific values to the tension control assemblies as a single command. In the embodiments of FIG. 9, since only on/off signals are sent, e.g. a tension setpoint value command is sent as a series of "up" or "down" commands, each of which increments the tension setpoint up or down by one unit of measure. In the alternative, the operator interface can translate the information from the main PLC into analog signals and communicate to and from the tension control assemblies using such analog signals. Any such analog signals received from the tension control assemblies are translated by the operator control station into digital signals, which are then communicated to the main PLC.

Figure 10:
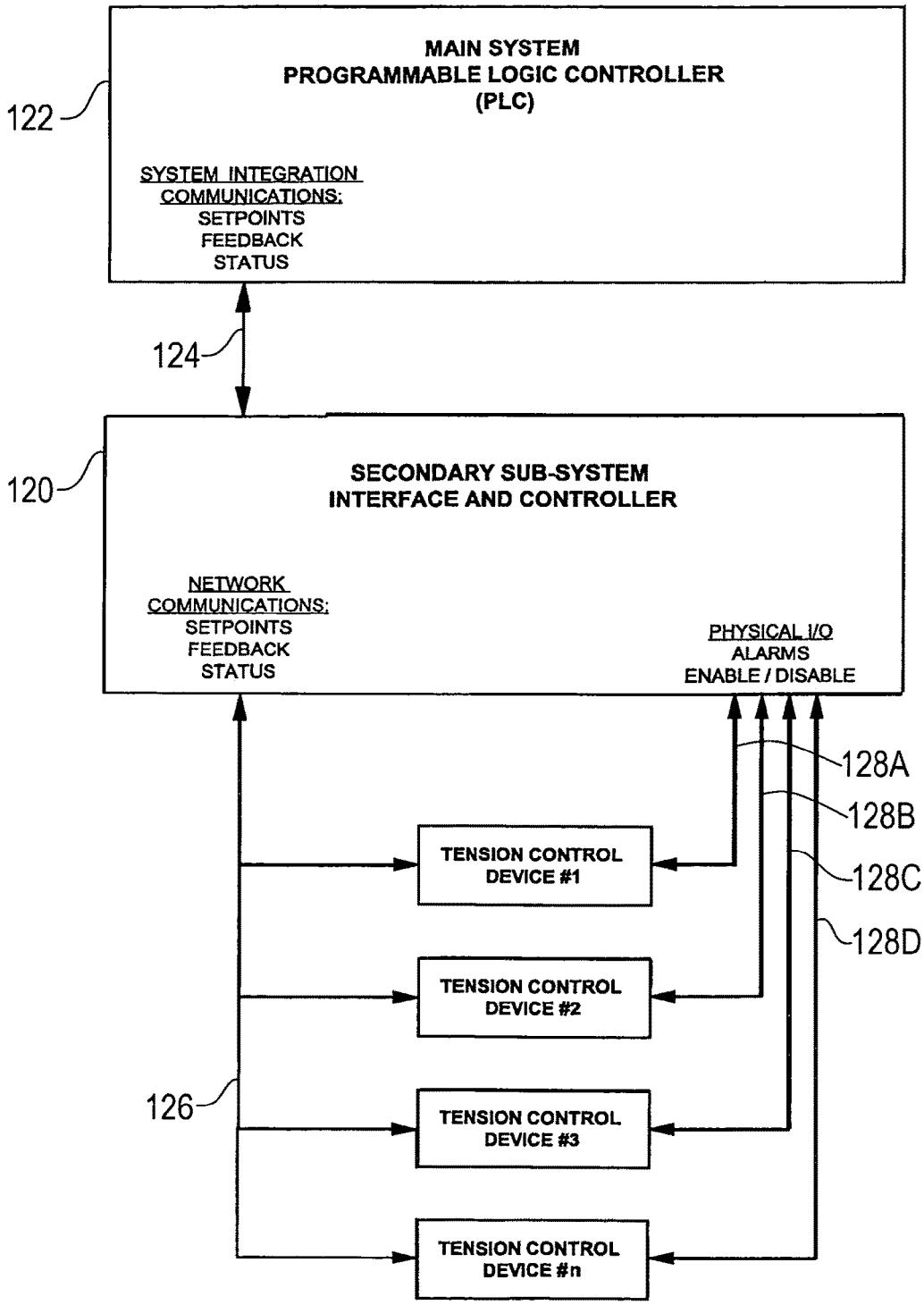

In the embodiments illustrated in FIG. 10, all communications flow through the operator control station. Value signals are translated by the operator control station as in FIGS. 7 and 8. On/off signals such as the enable/disable switch signals, and alarm on/off signals are sent and received by the operator control station. The operator control station can send the raw data back to the main PLC, or can send only summary information to the main PLC.

In any embodiments which use an operator control station 120, optionally with communications to the main PLC, data sent to and received from the tension control assemblies can be stored in a memory device, such as for historical purposes. Such memory device can be part of the main PLC, part of the operator control station, a stand-alone memory device, or a memory device embodied elsewhere, either on-site or off-site with respect to the manufacturing operation. Such historical information can be used e.g. for analyzing engineering issues, for analyzing safety issues regarding the manufactured product, or the like.

In light of the above discussion of FIGS. 7-10, a secondary controller 120 can be used to pass setpoints from the main PLC to the tensioning devices. The secondary controller, in turn, passes feedback and status information from the tension control devices to the main PLC. This secondary controller can merely act as an interface device or protocol converter between the main PLC and the tension control devices. Other timing, control, and monitoring functions also can be performed in such secondary controller. In an alternative embodiment, the communications conversions take place inside the main system PLC so that the main PLC can directly communicate to the tensioning devices.

Communications Between Main System PLC and Secondary Sub-System PLC

Information which can be communicated from the main PLC to the secondary controller includes, but is not limited to, various control setpoints such as Tension Setpoints. Each tension device can have a unique setpoint. Groups of devices can have the same tension setpoint.

Tension Deviation Alarm Tolerance. The amount of deviation from the tension setpoint which is allowable as sensed in the tensioned thread.

Startup Time. A greater tension deviation can be allowable while the production line is ramping up to speed.

Production Line Speed. Different tension settings can be used for different line speeds such as thread up, slow run, and normal run. The secondary controller communicates the proper tension setpoints to the tensioning devices based on the speed of the main production line.

Device selection/activation/disabling. Not all tensioning devices are used for all product configurations. Accordingly, some tensioning devices can be disabled in some configurations of the manufacturing operation.

Typical information which must be communicated from the secondary interface controller to the main PLC includes Condition/Status of the tensioning devices such as tension or other alarms, drive temperature, drive current.

Tension Feedback. Actual feedback value from individual ones of the tension sensors.

Methods of communications between main system PLC and secondary sub-system interface controller include any one of the common industrial communications protocols. Such protocols can be used to pass information between the mail PLC and the sub-system interface controller. Useful protocols include but are not limited to Ethernet,
Device Net,
Modbus RTU,
Control Net,
Profibus,
CC-Link,
CAN bus, and
ASCII serial communications.

An alternate method of communication between main system PLC and secondary sub-system interface controller:

The setpoint, feedback, and status values can also be communicated between the main PLC and the secondary sub-system controller using analog inputs and outputs. For example, a 0-10VDC analog output can be used by the main PLC to command tension setpoint of 0-200 grams. An analog input on the secondary controller can read the tension setpoint value from the main PLC and use the tension setpoint value in the main PLC to set the tension setpoint in the tensioning devices. Similarly, a 0-10VDC analog output from the secondary controller can be used to communicate tension feedback or system health to an analog input on the main system PLC.

Communications Between Secondary Controller and Tensioning Devices

Serial Communications:

A typical baby diaper production line has 4-12 tensioning devices. A typical adult incontinent product production line has up to e.g. about 72 tensioning devices, or more. Using a proprietary communications protocol available for the KTF tensioning devices, from BTSR, the secondary sub-system controller can communicate setpoint values to each tensioning device. It is possible for one sub-system controller to communicate with several hundred tensioning devices, as needed. Use of such secondary controllers enables substantial reduction in the physical wiring between the controller and the tensioning devices, compared to other methods of controlling setpoints.

Increase/Decrease Pulses:

Some stand-alone tensioning devices such as the BTSR brand KTF-RW model allow for the pre-programmed tension setpoint to be temporarily modified when the system is active using physical digital inputs. After motion begins, inputs for "increase" or "decrease" can be pulsed on and off to increment or decrement the tension setpoint. Each pulse can change the active tension setpoint by a pre-determined value. For example, if the pre-programmed tension setpoint is 100 grams, the "increase" input can be pulsed 5 times to temporarily change the tension setpoint to 105 grams.

Analog Inputs/Outputs:

Some stand-alone tensioning devices can accept analog signals such as 0-10VDC or 4-20 mA as tension setpoints. The secondary sub-system interface controller can receive control setpoint demand information from the main system PLC and convert the demand values to analog control signals.

The analog control signals can be sent to the individual tensioning devices, e.g. KTR-RW, to be used as tension setpoints.

Enable/Disable Tensioning Devices:

Most tensioning devices require some sort of enable/disable signal to reduce or disable the tensioning mechanism (motor, brake, etc.) when the production line is not moving. This enable/disable signal can be a physical input or it can be sent via a serial communications signal.

Monitor Alarm Output from each Device:

Secondary controller 120 can monitor a physical alarm output from each tensioning device. This alarm output can indicate a tension error, broken or missing thread, drive fault, sensor fault, or some other tension system fault. The secondary controller communicates actionable alarm signals to the main PLC. The main PLC makes go/no-go decisions, and issues corresponding commands, based on such alarm signals.

The use of a secondary sub-system controller to provide inputs and outputs to control the pulsing logic and alarm monitoring for such control configuration reduces the installation time and expense, compared to using the main system PLC for such functions.

Sub-System Controller Optional Features

Tension Data Logging:

The feedback from the tension sensors can be used to log the actual tension of each individual thread which is being fed into the manufacturing process. This data can be used to verify the quality and consistency of the products which are being made with the production process.

Alarm Logging:

The secondary controller can be used to detect alarm or warning conditions such as: tension outside allowable deviation limits, missing or broken threads, drive faults, and the like. The date, time, and frequency of these events can be logged for later evaluation. The logged data can be stored in the memory of the secondary controller, or it can be stored on a removable memory storage device. It may also be uploaded to the main PLC 122, or to a PC or other device having available data storage capability.

Recipe Storage:

In certain product configurations, different tensioning devices can have different tension setpoints. Such differences can provide contoured/varying tension, a tension variation, a tension gradation, across a product, or can compensate for mechanical differences in the production line. Different products produced on the same line can specify the use of different setpoint values on each tensioning device. Such groups of control setpoints can be stored as "recipes" in the secondary controller. When a new product is to be run on the production line, it is only necessary for the main system PLC to select from one of the saved "recipes" rather than transmitting all of the setpoint values for each of the tensioning devices. The corresponding setpoint values in the recipe are then communicated from the secondary controller to the respective tensioning devices.

Speed Variable Tension Settings:

It is often desirable to use different tension setpoints at different machine speeds. For example, during initial startup, a relatively lower tension value reduces the likelihood of thread breaks. Similarly different tension setpoints can provide optimum performance at jog speed vs. full run speed. The secondary controller can automatically adjust the setpoints of the tensioning devices based on production line speed.

Communications Interface Device, General Capabilities of the Secondary Controller An industrial control device, such as secondary controller 120, which can communicate both with industry standard PLC's and with stand-alone tensioning devices such as KTF's.

The secondary controller can communicate with industrial PLC's using a standard industrial communications protocols such as Ethernet
Control Net
Device Net
Profibus
Modbus
ASCII serial
CC-Link
DF-1
DH+
RS-232
RS-485
RS-422

The secondary controller can use analog inputs and outputs to communicate values of setpoints, feedback, and/or status.

The secondary controller can use digital input/output to select preset control setpoints and to communicate status and alarm conditions with main PLC 122.

The secondary controller can communicate with the tension control device using serial/network communications such as:

RS-232
RS-485
RS-422 including use of an optional protocol converter to convert standard RS-232 to other protocols such as proprietary 9-bit RS-485.

Digital outputs from the secondary controller can be used to increase or decrease tension relative to a preset value which is stored in the memory of the tension control device.

Digital output from the secondary controller can be used to enable, disable, reset, and/or adjust alarm monitoring functions in the tension control devices.

Digital output from the secondary controller can be used to enable or disable one or more selected ones of the tension control devices, thereby to operationally deactivate a tension control device from the manufacturing operation, or to operationally activate a tension control device into the manufacturing operation.

Digital inputs to the secondary controller can be used to monitor the unwind and feed system for alarm signals on the tension control devices.

The secondary controller can provide analog outputs and receive analog inputs. Exemplary such analog signals include 0-10VDC, 0-20 mA, 4-20 mA analog signals, which can be used to set tension setpoints in tension control devices.

Additional functions of the secondary controller, which functions as a communications interface device/multiple position tension controller, include Distribution of all control setpoints to multiple tension control devices, Monitoring of tension feedback values to determine if actual tensions are within allowable tolerances relative to tension setpoints, Storing multiple groups of control setpoints or parameter recipes for various product configurations, Monitoring alarm status for multiple tension control devices, Logging history of alarms including but not limited to date, time, and frequency of alarms for each tension control device, and Communicating tensioning device status to the main controller to indicate alarm or warning conditions which may require operator intervention or the stopping of the manufacturing operation.

The invention further contemplates methods of controlling thread unwind and feed operations using the secondary controller, either alone or in combination with a main PLC which controls the overall manufacturing operation.

Those skilled in the art will now see that certain modifications can be made to the apparatus and methods herein disclosed with respect to the illustrated embodiments, without departing from the spirit of the instant invention. And while the invention has been described above with respect to the preferred embodiments, it will be understood that the invention is adapted to numerous rearrangements, modifications, and alterations, and all such arrangements, modifications, and alterations are intended to be within the scope of the appended claims.

To the extent the following claims use means plus function language, it is not meant to include there, or in the instant specification, anything not structurally equivalent to what is shown in the embodiments disclosed in the specification.

Having thus described the invention, what is claimed is:

1. Thread capture apparatus adapted to capture loping thread being drawn off a package of such thread, said thread capture apparatus comprising a plurality of thread capture elements which are collectively effective to capture such loping thread and to substantially eliminate such loping action in such thread downstream of said thread capture apparatus, each said thread capture element defining at least one thread engaging surface, such thread engaging surfaces being adapted to move in directions corresponding to longitudinal directions of movement of such thread across the respective said thread capture elements, said thread capture apparatus comprising, as a first said thread capture element, a first rolling capture element comprising a first elongate roller having a first said thread engaging surface, said first elongate roller being adapted and positioned to serve as an initial contact element for such thread being drawn from such package of thread, said first thread capture element having a first axis of rotation generally transverse to the longitudinal direction of movement of such thread across said first thread capture element, as a second said thread capture element, a second rolling capture element proximately downstream from said first rolling capture element, said second rolling capture element having a second said thread engaging surface and a second axis of rotation transverse to the first axis of rotation of said first thread capture element, as a third said thread capture element, a third rolling capture element proximate said second rolling capture element, said third rolling capture element having a third said thread engaging surface and a third axis of rotation transverse to the first axis of rotation of said first thread capture element, said first elongate roller being disposed in a first orientation wherein the first axis of rotation is transverse to the general direction of advance of such loping thread before such thread reaches said first elongate roller, and wherein such thread encounters said first rolling capture element, as the initial contact element after leaving such package of thread, and wherein such thread, during normal dynamic ongoing operation of said thread capture apparatus, passes across a surface of said first elongate roller, and from said first elongate roller onto said second rolling capture element, turns around said second rolling capture element, and passes thence onto said third rolling capture element, and turns around said third rolling capture element.

2. Thread capture apparatus as in claim 1 wherein said first, second, and third thread capture elements are adapted to be driven by motive forces imposed on the first, second, and third thread engaging surfaces by such thread.

3. A thread unwind and feed system comprising thread capture apparatus as in claim 1, further comprising a thread tension control device proximate said thread capture apparatus, said thread tension control device being adapted to receive such thread downstream of said thread capture apparatus, and proximate said thread capture apparatus, and to adjust tension in such thread toward a desired tension.

4. Thread capture apparatus as in claim 1, further comprising, as a fourth thread capture element, a second elongate roller having a fourth axis of rotation, said first and fourth thread capture elements being located so as to be at a generally common distance from such package of thread, both of said first and fourth thread capture elements being adapted and positioned to serve as an initial contact element for such thread being drawn off such package of thread.

5. Thread capture apparatus as in claim 1 wherein said second and third thread capture elements comprise elongate rollers.

6. Thread capture apparatus as in claim 5, the third axis of rotation of said third thread capture element being generally parallel to the second axis of rotation of said second thread capture element.

7. Thread capture apparatus as in claim 6 wherein said first elongate roller is disposed in an upright orientation, and said second and third thread capture elements are disposed in generally horizontal orientations in close proximity to each other.

8. Thread capture apparatus as in claim 1 wherein said first thread capture element has primary affect of reducing magnitude of a first set of opposing vectors of kinetic energy in such loping thread, and wherein said second thread capture element has primary affect of reducing magnitude of a second set of vectors acting generally perpendicular to the first set of opposing vectors.

9. Thread capture apparatus as in claim 1, said thread capture apparatus being adapted to capture loping elastic thread being drawn overend from such package of such elastic thread and wherein said first rolling capture element acts primarily on a first set of opposingly-directed vectors of such loping thread.

10. Thread capture apparatus as in claim 9 wherein said first thread capture element acts secondarily on vectors perpendicular to such first set of opposingly-directed vectors.

11. Thread capture apparatus as in claim 1 wherein said first elongate roller is so positioned that such thread approaches said first elongate roller from a first general direction, wraps said first elongate roller such that such thread leaves said first elongate roller in a second different direction and advances to said second thread capture element, leaves said second thread capture element in a third direction and advances to said third thread capture element, and leaves said third thread capture element in a fourth different direction.

12. A thread unwind and feed system comprising thread capture apparatus as in claim 1, further comprising a brake, having a thread-engaging rotating surface, disposed proximately downstream from said thread capture apparatus wherein said thread-engaging surface of said brake is driven by surface contact with such thread, and wherein such thread passes from the last of said plurality of thread capture elements to said brake, as a next thread-engaging device during normal dynamic ongoing operation of said thread unwind and feed system.

13. A thread unwind and feed system as in claim 12, further comprising a static thread guide which encompasses such thread between said thread capture apparatus and said brake, and wherein such thread does not touch said static thread guide during normal dynamic ongoing operation of said thread unwind and feed system, and supports a slack portion of such thread, slack on opposing sides of such static thread guide, when operation of said thread unwind and feed system stops.

14. A thread unwind and feed system comprising thread capture apparatus as in claim 4 wherein the first and fourth axes of rotation are disposed in a generally upright orientation, wherein said first and fourth thread capture elements act primarily on horizontally-directed vectors of such loping thread, wherein the second and third axes of rotation of said second and third thread capture elements are generally horizontal, and wherein such thread, during normal dynamic ongoing operation of said thread capture apparatus, passes from at least one of said first and fourth thread capture elements onto said second thread capture element, turns around said second thread capture element, and passes thence onto said third thread capture element, turns around said third thread capture element and exits said third thread capture element, and encounters a moving surface of a rolling brake disposed proximately downstream from said thread capture elements.

15. A thread unwind and feed system comprising thread capture apparatus as in claim 3 wherein said thread tension control device adjusts tension in such thread to at least 50 percent of a downstream target thread tension.

16. Thread capture apparatus adapted to capture a thread being drawn from a source, said thread capture apparatus comprising a plurality of thread capture elements which are collectively effective to capture such thread, each said thread capture element defining at least one thread engaging surface, such thread engaging surfaces being adapted to move in directions corresponding to longitudinal directions of movement of such thread across the respective said thread capture elements, said thread capture apparatus comprising, as a first said thread capture element, a first rolling capture element comprising a first elongate roller having a first said thread engaging surface, said first elongate roller being adapted and positioned to serve as an initial contact element for such thread being drawn from such package of thread, said first thread capture element having a first axis of rotation generally transverse to the longitudinal direction of movement of such thread across said first thread capture element, as a second said thread capture element, a second rolling capture element proximately downstream from said first rolling capture element, said second rolling capture element having a second said thread engaging surface and a second axis of rotation transverse to the first axis of rotation of said first thread capture element, as a third said thread capture element, a third rolling capture element, said third thread capture element having a third said thread engaging surface and a third axis of rotation transverse to the first axis of rotation of said first thread capture element, and said second rolling capture element being between said third rolling capture element and said first rolling capture element, said thread capture apparatus being adapted to receive a thread advancing from such thread package at one of said plurality of thread capture elements, such that such thread subsequently encounters said second rolling capture element, and after encountering said second rolling capture element, encounters said third rolling capture element.

17. Thread capture apparatus as in claim 16, said thread capture apparatus being adapted to capture loping elastic thread being drawn overend from a package of such elastic thread and to substantially eliminate such loping action in such thread downstream from said thread capture apparatus.

18. Thread capture apparatus as in claim 16 wherein said first thread capture element is mounted to a support such that said first elongate roller is fixed in position relative to such support.

19. Thread capture apparatus as in claim 16 wherein such thread, after leaving such spool of thread, next encounters said first thread capture element.

20. Thread capture apparatus as in claim 16, said second and third thread capture elements being in close proximity to each other.

21. Thread capture apparatus adapted to capture loping thread being drawn off a package of such thread, said thread capture apparatus comprising a plurality of thread capture elements collectively effective to capture such loping thread and to substantially eliminate such loping action in such thread downstream of said thread capture apparatus, each said thread capture element defining at least one thread engaging surface, such thread engaging surfaces being adapted to move in directions corresponding to longitudinal directions of movement of such thread across the respective said thread capture elements, said thread capture apparatus comprising, as a first thread capture element, a first rolling capture element comprising a first elongate roller having a first said thread engaging surface, said first elongate roller being adapted and positioned to serve as an initial contact for such thread being drawn from such package of thread, said first thread capture element having a first axis of rotation generally transverse to the longitudinal direction of movement of such thread across said first thread capture element, as a second said thread capture element, a second rolling capture element proximately downstream from said first rolling capture element, and along a path of travel of such thread, said second rolling capture element having a second said thread engaging surface and a second axis of rotation transverse to the first axis of rotation of said first thread capture element, and transverse to such path of travel of such thread, and a rolling thread guide positioned relative to said first and second thread capture elements, and downstream along such thread path from said second thread capture element, said first and second thread capture elements, and said rolling thread guide being so positioned and oriented that such thread, when drawn along such thread path by a force exerted at said rolling thread guide, approaches said first thread capture element from a first direction, wraps about said first thread capture element and leaves said first thread capture element in a second different direction directed toward said second thread capture element, wraps about said second thread capture element at least 90 degrees, and leaves said second thread capture element in a third different direction directed toward said rolling thread guide, and traverses thence along such third direction to said rolling thread guide.

22. A thread unwind and feed system adapted to draw thread from a package of such thread and to feed such thread in a downstream direction, along a thread feed path, to a dynamically operating downstream process, thereby to deliver such thread to such downstream process at a target tension level, said thread unwind and feed system comprising:

a thread capture apparatus as in claim 21, a first tension control apparatus proximate said thread capture apparatus, said first tension control apparatus being adapted to add a first increment of tension to such thread such that the resulting tension, as such thread leaves said first tension control, is greater than such tension in such thread when approaching said first tension control apparatus and less than the target tension, and a second tension control apparatus at least 2 meters downstream along the thread path from said first tension control apparatus, said second tension control apparatus being adapted to increase or decrease such tension so as to reduce any variance between the target tension and such tension in such thread.

23. A thread unwind and feed system as in claim 22 wherein said second tension control apparatus includes (i) a tension incrementing driver defining a thread engaging surface, said tension incrementing driver being adapted to change a speed of such thread traversing said second tension control apparatus at the respective said thread engaging surface, thereby to adjust the tension in such thread, (ii) a tension sensor downstream from said tension incrementing driver, and (iii) a control system defining a closed control loop whereby tension is incremented by said tension incrementing driver in response to the level of tension as sensed in such thread by said sensor.

24. A thread unwind and feed system as in claim 23 wherein said second tension control apparatus is adapted to advance or retard such speed of such thread in order to thereby increase or decrease the tension in such thread and correspondingly to reduce any variance between the target tension and the tension sensed at said tension sensor.

25. A thread unwind and feed system as in claim 24 wherein said first tension control apparatus is a passive tension control apparatus, receiving no driving energy input except motive force applied by such thread moving across the respective thread engaging surface.

26. A thread unwind and feed system as in claim 23 wherein said first tension control apparatus is a passive tension control apparatus, receiving no driving energy input except motive force applied by such thread moving across the respective thread engaging surface.

27. A thread unwind and feed system as in claim 22 wherein said first tension control apparatus applies sufficient tension to such thread that the resulting tension in such thread is at least 50 percent of the target tension.

28. A thread unwind and feed system as in claim 27 wherein said second tension control apparatus includes a tension incrementing driver, a sensor downstream from said tension incrementing driver, and a control system defining a closed control loop whereby tension is incremented by said tension incrementing driver in response to the level of tension as sensed in such thread by said sensor.

29. A thread unwind and feed system as in claim 22 wherein said second tension control apparatus refines such tension in such thread, toward the target tension.

30. A thread unwind and feed system adapted to draw thread from a package of such thread and to feed such thread in a downstream direction, along a thread feed path, to a dynamically operating downstream process, thereby to deliver such thread to such downstream process at a target tension level, said thread unwind and feed system comprising:

a thread capture apparatus as in claim 21, a first tension control apparatus proximate said thread capture apparatus, said first tension control apparatus having a thread engaging surface and being adapted to add a first increment of tension to such thread such that the resulting tension, as such thread leaves said first tension control, is greater than such tension in such thread when approaching said first tension control apparatus and less than the target tension, and a second tension control apparatus downstream along the thread path from said first tension control apparatus and within 3 meters of such downstream process, said second tension control apparatus being adapted to fine tune such tension in such thread, thereby to increase or decrease such tension so as to reduce any variance between the target tension and such tension in such thread.

31. A thread unwind and feed system as in claim 30 wherein said second tension control apparatus includes (i) a tension incrementing driver defining a thread engaging surface, said tension incrementing driver being adapted to change a speed of such thread traversing said second tension control apparatus at the respective said thread engaging surface, thereby to adjust the tension in such thread, (ii) a tension sensor downstream from said tension incrementing driver, and (iii) a control system defining a closed control loop whereby tension is incremented by said tension incrementing driver in response to the level of tension as sensed in such thread by said sensor.

32. A thread unwind and feed system as in claim 31 wherein said second tension control apparatus is adapted to advance or retard such speed of such thread in order to thereby increase or decrease the tension in such thread and correspondingly to reduce any variance between the target tension and the tension sensed at said tension sensor.

33. A thread unwind and feed system as in claim 32 wherein said first tension control apparatus is a passive tension control apparatus, receiving no driving energy input except motive force applied by such thread moving across the respective thread engaging surface.

34. A thread unwind and feed system as in claim 31 wherein said first tension control apparatus is a passive tension control apparatus, receiving no driving energy input except motive force applied by such thread moving across the respective thread engaging surface.

35. A thread unwind and feed system as in claim 30 wherein said first tension control apparatus applies sufficient tension to such thread that the resulting tension in such thread is at least 50 percent of the target tension.

36. A thread unwind and feed system as in claim 35 wherein said first tension control apparatus applies sufficient tension to such thread that the resulting tension in such thread is at least 50 percent of the target tension and wherein said second tension control apparatus includes a tension incrementing driver, a sensor downstream from said tension incrementing driver, and a control system defining a closed control loop whereby tension is incremented by said tension incrementing driver in response to the level of tension as sensed in such thread by said sensor.

37. A thread unwind and feed system adapted to draw thread from a package of such thread and to feed such thread in a downstream direction, along a thread feed path, to a dynamically operating downstream process, thereby to deliver such thread to such downstream process at a target tension level, said thread unwind and feed system comprising:

a thread capture apparatus as in claim 1, a first tension control apparatus proximate said thread capture apparatus, said first tension control apparatus being adapted to add a first increment of tension to such thread such that the resulting tension, as such thread leaves said first tension control, is greater than such tension in such thread when approaching said first tension control apparatus and less than the target tension, and a second tension control apparatus at least 2 meters downstream along the thread path from said first tension control apparatus, said second tension control apparatus being adapted to increase or decrease such tension so as to reduce any variance between the target tension and such tension in such thread.

38. A thread unwind and feed system as in claim 37 wherein said second tension control apparatus includes (i) a tension incrementing driver defining a thread engaging surface, said tension incrementing driver being adapted to change a speed of such thread traversing said second tension control apparatus at the respective said thread engaging surface, thereby to adjust the tension in such thread, (ii) a tension sensor downstream from said tension incrementing driver, and (iii) a control system defining a closed control loop whereby tension is incremented by said tension incrementing driver in response to the level of tension as sensed in such thread by said sensor.

39. A thread unwind and feed system as in claim 38 wherein said second tension control apparatus is adapted to advance or retard such speed of such thread in order to thereby increase or decrease the tension in such thread and correspondingly to reduce any variance between the target tension and the tension sensed at said tension sensor.

40. A thread unwind and feed system as in claim 39 wherein said first tension control apparatus is a passive tension control apparatus, receiving no driving energy input except motive force applied by such thread moving across the respective thread engaging surface.

41. A thread unwind and feed system as in claim 38 wherein said first tension control apparatus is a passive tension control apparatus, receiving no driving energy input except motive force applied by such thread moving across the respective thread engaging surface.

42. A thread unwind and feed system as in claim 41 wherein said second tension control apparatus is adapted to advance or retard such speed of such thread in order to thereby increase or decrease the tension in such thread and correspondingly to reduce any variance between the target tension and the tension sensed at said tension sensor.

43. A thread unwind and feed system as in claim 42 wherein said first tension control apparatus is a passive tension control apparatus, receiving no driving energy input except motive force applied by such thread moving across the respective thread engaging surface.

44. A thread unwind and feed system as in claim 37 wherein said first tension control apparatus applies sufficient tension to such thread that the resulting tension in such thread is at least 50 percent of the target tension.

45. A thread unwind and feed system as in claim 44 wherein said second tension control apparatus includes a tension incrementing driver, a sensor downstream from said tension incrementing driver, and a control system defining a closed control loop whereby tension is incremented by said tension incrementing driver in response to the level of tension as sensed in such thread by said sensor.

46. A thread unwind and feed system as in claim 37 wherein said second tension control apparatus refines such tension in such thread, toward the target tension.

47. A thread unwind and feed system adapted to draw thread from a package of such thread and to feed such thread in a downstream direction, along a thread feed path, to a dynamically operating downstream process, thereby to deliver such thread to such downstream process at a target tension level, said thread unwind and feed system comprising:

a thread capture apparatus as in claim 1, a first tension control apparatus proximate said thread capture apparatus, said first tension control apparatus having a thread engaging surface and being adapted to add a first increment of tension to such thread such that the resulting tension, as such thread leaves said first tension control, is greater than such tension in such thread when approaching said first tension control apparatus and less than the target tension, and a second tension control apparatus downstream along the thread path from said first tension control apparatus and within 3 meters of such downstream process, said second tension control apparatus being adapted to fine tune such tension in such thread, thereby to increase or decrease such tension so as to reduce any variance between the target tension and such tension in such thread.

48. A thread unwind and feed system as in claim 47 wherein said second tension control apparatus includes (i) a tension incrementing driver defining a thread engaging surface, said tension incrementing driver being adapted to change a speed of such thread traversing said second tension control apparatus at the respective said thread engaging surface, thereby to adjust the tension in such thread, (ii) a tension sensor downstream from said tension incrementing driver, and (iii) a control system defining a closed control loop whereby tension is incremented by said tension incrementing driver in response to the level of tension as sensed in such thread by said sensor.

49. A thread unwind and feed system as in claim 48 wherein said first tension control apparatus is a passive tension control apparatus, receiving no driving energy input except motive force applied by such thread moving across the respective thread engaging surface.

50. A thread unwind and feed system as in claim 47 wherein said first tension control apparatus applies sufficient tension to such thread that the resulting tension in such thread is at least 50 percent of the target tension.

51. A thread unwind and feed system as in claim 50 wherein said second tension control apparatus includes a tension incrementing driver, a sensor downstream from said tension incrementing driver, and a control system defining a closed control loop whereby tension is incremented by said tension incrementing driver in response to the level of tension as sensed in such thread by said sensor.

52. A thread unwind and feed system adapted to draw thread from a package of such thread and to feed such thread in a downstream direction, along a thread feed path, to a dynamically operating downstream process, thereby to deliver such thread to such downstream process at a target tension level, said thread unwind and feed system comprising:

a thread capture apparatus as in claim 16, a first tension control apparatus proximate said thread capture apparatus, said first tension control apparatus being adapted to add a first increment of tension to such thread such that the resulting tension, as such thread leaves said first tension control, is greater than such tension in such thread when approaching said first tension control apparatus and less than the target tension, and a second tension control apparatus at least 2 meters downstream along the thread path from said first tension control apparatus, said second tension control apparatus being adapted to increase or decrease such tension so as to reduce any variance between the target tension and such tension in such thread.

53. A thread unwind and feed system as in claim 52 wherein said second tension control apparatus includes (i) a tension incrementing driver defining a thread engaging surface, said tension incrementing driver being adapted to change a speed of such thread traversing said second tension control apparatus at the respective said thread engaging surface, thereby to adjust the tension in such thread, (ii) a tension sensor downstream from said tension incrementing driver, and (iii) a control system defining a closed control loop whereby tension is incremented by said tension incrementing driver in response to the level of tension as sensed in such thread by said sensor.

54. A thread unwind and feed system as in claim 53 wherein said second tension control apparatus is adapted to advance or retard such speed of such thread in order to thereby increase or decrease the tension in such thread and correspondingly to reduce any variance between the target tension and the tension sensed at said tension sensor.

55. A thread unwind and feed system as in claim 54 wherein said first tension control apparatus is a passive tension control apparatus, receiving no driving energy input except motive force applied by such thread moving across the respective thread engaging surface.

56. A thread unwind and feed system as in claim 53 wherein said first tension control apparatus is a passive tension control apparatus, receiving no driving energy input except motive force applied by such thread moving across the respective thread engaging surface.

57. A thread unwind and feed system as in claim 52 wherein said first tension control apparatus applies sufficient tension to such thread that the resulting tension in such thread is at least 50 percent of the target tension.

58. A thread unwind and feed system as in claim 57 wherein said second tension control apparatus includes a tension incrementing driver, a sensor downstream from said tension incrementing driver, and a control system defining a closed control loop whereby tension is incremented by said tension incrementing driver in response to the level of tension as sensed in such thread by said sensor.

59. A thread unwind and feed system as in claim 52 wherein said second tension control apparatus refines such tension in such thread, toward the target tension.

60. A thread unwind and feed system adapted to draw thread from a package of such thread and to feed such thread in a downstream direction, along a thread feed path, to a dynamically operating downstream process, thereby to deliver such thread to such downstream process at a target tension level, said thread unwind and feed system comprising:

a thread capture apparatus as in claim 16, a first tension control apparatus proximate said thread capture apparatus, said first tension control apparatus having a thread engaging surface and being adapted to add a first increment of tension to such thread such that the resulting tension, as such thread leaves said first tension control, is greater than such tension in such thread when approaching said first tension control apparatus and less than the target tension, and a second tension control apparatus downstream along the thread path from said first tension control apparatus and within 3 meters of such downstream process, said second tension control apparatus being adapted to fine tune such tension in such thread, thereby to increase or decrease such tension so as to reduce any variance between the target tension and such tension in such thread.

61. A thread unwind and feed system as in claim 60 wherein said second tension control apparatus includes (i) a tension incrementing driver defining a thread engaging surface, said tension incrementing driver being adapted to change a speed of such thread traversing said second tension control apparatus at the respective said thread engaging surface, thereby to adjust the tension in such thread, (ii) a tension sensor downstream from said tension incrementing driver, and (iii) a control system defining a closed control loop whereby tension is incremented by said tension incrementing driver in response to the level of tension as sensed in such thread by said sensor.

62. A thread unwind and feed system as in claim 61 wherein said second tension control apparatus is adapted to advance or retard such speed of such thread in order to thereby increase or decrease the tension in such thread and correspondingly to reduce any variance between the target tension and the tension sensed at said tension sensor.

63. A thread unwind and feed system as in claim 62 wherein said first tension control apparatus is a passive tension control apparatus, receiving no driving energy input except motive force applied by such thread moving across the respective thread engaging surface.

64. A thread unwind and feed system as in claim 61 wherein said first tension control apparatus is a passive tension control apparatus, receiving no driving energy input except motive force applied by such thread moving across the respective thread engaging surface.

65. A thread unwind and feed system as in claim 60 wherein said first tension control apparatus applies sufficient tension to such thread that the resulting tension in such thread is at least 50 percent of the target tension.

66. A thread unwind and feed system as in claim 65 wherein said second tension control apparatus includes a tension incrementing driver, a sensor downstream from said tension incrementing driver, and a control system defining a closed control loop whereby tension is incremented by said tension incrementing driver in response to the level of tension as sensed in such thread by said sensor.

* * * * *